US008646220B2

(12) United States Patent
Kopp et al.

(10) Patent No.: US 8,646,220 B2
(45) Date of Patent: Feb. 11, 2014

(54) COMBINATION WOOD AND PLASTIC ENCLOSURE

(75) Inventors: Robert G. Kopp, Elburn, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 504 days.

(21) Appl. No.: 12/915,901

(22) Filed: Oct. 29, 2010

(65) Prior Publication Data

US 2012/0102847 A1 May 3, 2012

(51) Int. Cl.
*E04B 1/348* (2006.01)
*E04B 1/19* (2006.01)

(52) U.S. Cl.
USPC ..... 52/79.1; 52/90.2; 52/79.12; 52/483.1; 52/489.1; 52/481.1

(58) Field of Classification Search
USPC ..... 52/36.1, 36.2, 90.1, 79.1–79.2, 79.12, 52/79.5, 479, 235, 483.1, 489.1, 481.1, 52/481.2, 582.1, 283–284, 762–763, 511, 52/281, 464, 468, 79, 653.1
See application file for complete search history.

(56) References Cited

U.S. PATENT DOCUMENTS 3,097,007 A * 7/1963 Eichacker et al. ..... 292/92
3,284,946 A * 11/1966 Christiansen ..... 446/105
3,866,381 A 2/1975 Eschbach et al.
3,886,706 A * 6/1975 Baker ..... 52/793.11
4,557,091 A 12/1985 Auer
4,597,237 A * 7/1986 Celli ..... 52/601
4,688,358 A * 8/1987 Madray ..... 52/93.2
4,910,932 A * 3/1990 Honigman ..... 52/280
5,036,634 A * 8/1991 Lessard et al. ..... 52/79.1
5,303,525 A * 4/1994 Magee ..... 52/306
D371,208 S 6/1996 De Zen
5,644,888 A * 7/1997 Johnson ..... 52/651.01
6,250,022 B1 6/2001 Paz et al.
6,823,639 B2 * 11/2004 Hampel ..... 52/598
7,100,332 B2 * 9/2006 Loesch ..... 52/79.5
7,464,509 B1 * 12/2008 Brown ..... 52/426
7,509,776 B2 * 3/2009 Reisman ..... 52/281
7,658,038 B2 * 2/2010 Mower et al. ..... 52/79.1

* cited by examiner

*Primary Examiner* — Jeanette E. Chapman
(74) *Attorney, Agent, or Firm* — McHale & Slavin, P.A.

(57) ABSTRACT

A system or kit of wood and plastic component materials is provided which can readily be assembled to form a structure. The components are precut so that measurement and cutting of the component materials is eliminated. The components are readily assembled using conventional fasteners. Components have precut notches in order to facilitate the assembly of the components without the requirement for measurements. This assures that the components will be assembled correctly and eliminates the opportunity for inaccurate measurements. The roof is formed from plastic panels secured to wooden trusses. The floor is formed from plastic panels secured to the wood framing of the walls. The plastic roof panels and plastic floor panels are designed to be secured to each other and to the wood frames to assure heavy duty interlocking construction of the components.

9 Claims, 35 Drawing Sheets

706
704
702

FIG. 12B
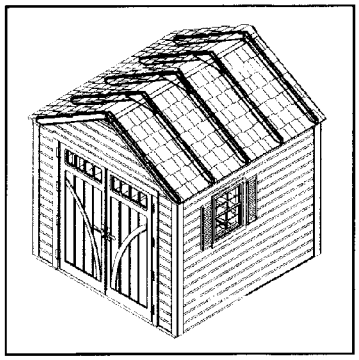
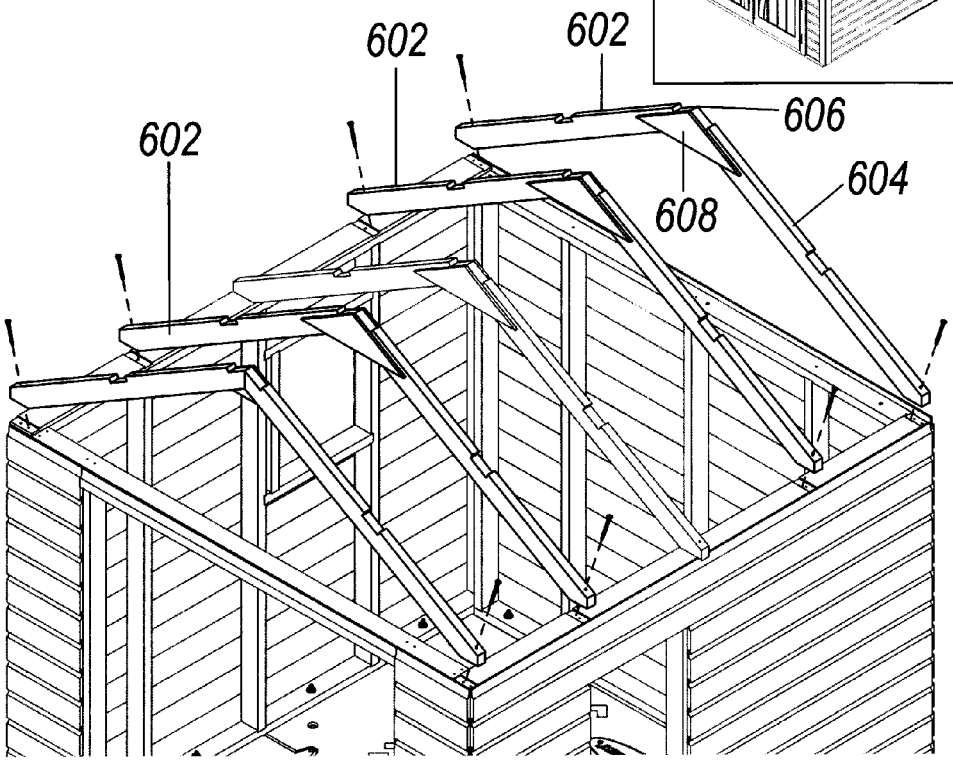
FIG. 12A

COMBINATION WOOD AND PLASTIC ENCLOSURE

FIELD OF THE INVENTION

This invention relates generally to enclosures, such as utility or garden sheds, constructed of wood and plastic materials. More specifically, the present invention relates to an enclosure including walls having wood framing and wood siding, a roof having wood rafters and plastic panel roofing, and a floor made from plastic panels.

BACKGROUND OF THE INVENTION

Utility sheds are a necessity for lawn and garden maintenance, as well as general all-around home storage space. Typically, items such as garden tractors, lawn mowers, garden tillers, snow blowers, ATVs, motorcycles and the like consume a great deal of floor space in a garage. This results in the homeowner parking his/her vehicles outside of the garage.

The prior art has proposed a number of different storage buildings or utility sheds assembled from a kit which includes a plurality of blow molded or extruded plastic panels and connectors. These kits are readily assembled by a homeowner to form storage structures or utility sheds of various sizes. These structures are generally suitable for the storage of hand tools and smaller lawn equipment. Typically, these kits require extruded metal or plastic connector members having a specific cross-sectional geometry which facilitates an engagement between the connector members and one or more of the blow molded plastic panels having a complimentary edge configuration. Due to the nature of the manufacturing process, blow molded plastic components cannot be formed with the intricate shapes and/or sharp corners required for integrated connectors. In addition, blow molded plastic components are hollow and cannot be formed with the integral strengthening ribs and gussets that injection molded panels can be formed with.

A particularly common structure for the connector members is the I-beam cross section. The I-beam defines free edge portions of the connector member which fit within approximately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel, and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process, the conduits are difficult to extrude in long sections for structural panels. Thus, the panels require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length. The protrusions are situated to slidably engage the conduits located in the side panel sections to create the height required for utility shed walls.

The aforementioned systems can also incorporate roof and floor panels to form a freestanding enclosed structure such as a utility shed. U.S. Pat. Nos. 3,866,381; 5,036,634; and 4,557,091 disclose various systems having inter-fitting panel and connector components. Such prior art systems, while working well, have not met all of the needs of consumers to provide the structural integrity required to construct larger sized structures. Larger structures must perform differently than smaller structures. Larger structures require constant ventilation in order to control moisture within the structure. Large structures must also withstand larger wind and snow loads compared to smaller structures. Paramount to achieving these needs is a panel system which eliminates the need for extruded connectors to create enclosure walls which resist panel separation, buckling, racking, and a roof system which allows ventilation while preventing weather infiltration. A further problem is that the walls formed by the panels must tie into the roof and floor in such a way as to unify the entire structure. Also, from a structural standpoint, the structure should include components capable of withstanding the increased wind, snow and storage loads required by larger structures. From a convenience standpoint, a door must be present which can be readily installed after assembly of the wall and roof components. The door must also be comparable with the sidewalls and provide ready access to the interior of the structure. Also, from a convenience standpoint, the structure should permit natural as well as artificial lighting. The structure should be aesthetically pleasing in appearance to blend in with the surrounding structures.

There are also commercial considerations that must be satisfied by any viable structure assembly system or kit; considerations which are not entirely satisfied by the state of the art products. The structure must be formed from relatively few components which are inexpensive to manufacture by conventional techniques. The enclosure must also be capable of being packaged and shipped in a knock-down state. In addition, the system or kit must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using integrally formed connectors requiring minimal hardware and tools. Further, the system must not require excessive strength to assemble or include heavy component parts. Moreover, the system must assemble together in such a way so as not to detract from the internal storage volume of the resulting enclosure, or otherwise detract from the internal storage volume of the resulting enclosure, or otherwise negatively affect the utility of the structure.

SUMMARY OF THE INVENTION

The present invention provides a system or kit of wood and plastic component materials which can readily be assembled to form a structure. The components are precut so that measurement and cutting of the component materials is eliminated. The components are readily assembled using conventional fasteners. Components have precut notches in order to facilitate the assembly of the components without the requirement for measurements. This assures that the components will be assembled correctly and eliminates the opportunity for inaccurate measurements. The roof is formed from plastic panels secured to wooden trusses. The floor is formed from plastic panels secured to the wood framing of the walls. The plastic roof panels and plastic floor panels are designed to be secured to each other and to the wood frames to assure heavy duty interlocking construction of the components.

Accordingly, it is an objective of the present invention to provide a utility enclosure system which utilizes precut wood and plastic components for creating structures of varying dimensions by using common components.

It is a further objective of the present invention to provide a utility enclosure which can be readily assembled using conventional fasteners.

It is yet another objective of the present invention to provide a utility enclosure including precut components having notches which enable assembly of the components without measurements of the components.

It is a still further objective of the present invention to provide an enclosure which allows for the rapid assembly of a roof by utilizing roof panels secured to trusses.

It is still another further objective of the present invention to provide an enclosure which utilizes a floor formed of plastic panels and fasteners which securely connect wood framed walls to the plastic floor panels.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 12A is a view of the roof trusses;

FIG. 12B is a view of the roof trusses in relation to the entire enclosure;

FIG. 16B is a view of the gable vents in relation to the entire enclosure;

DETAILED DESCRIPTION OF THE INVENTION

Figure 1:
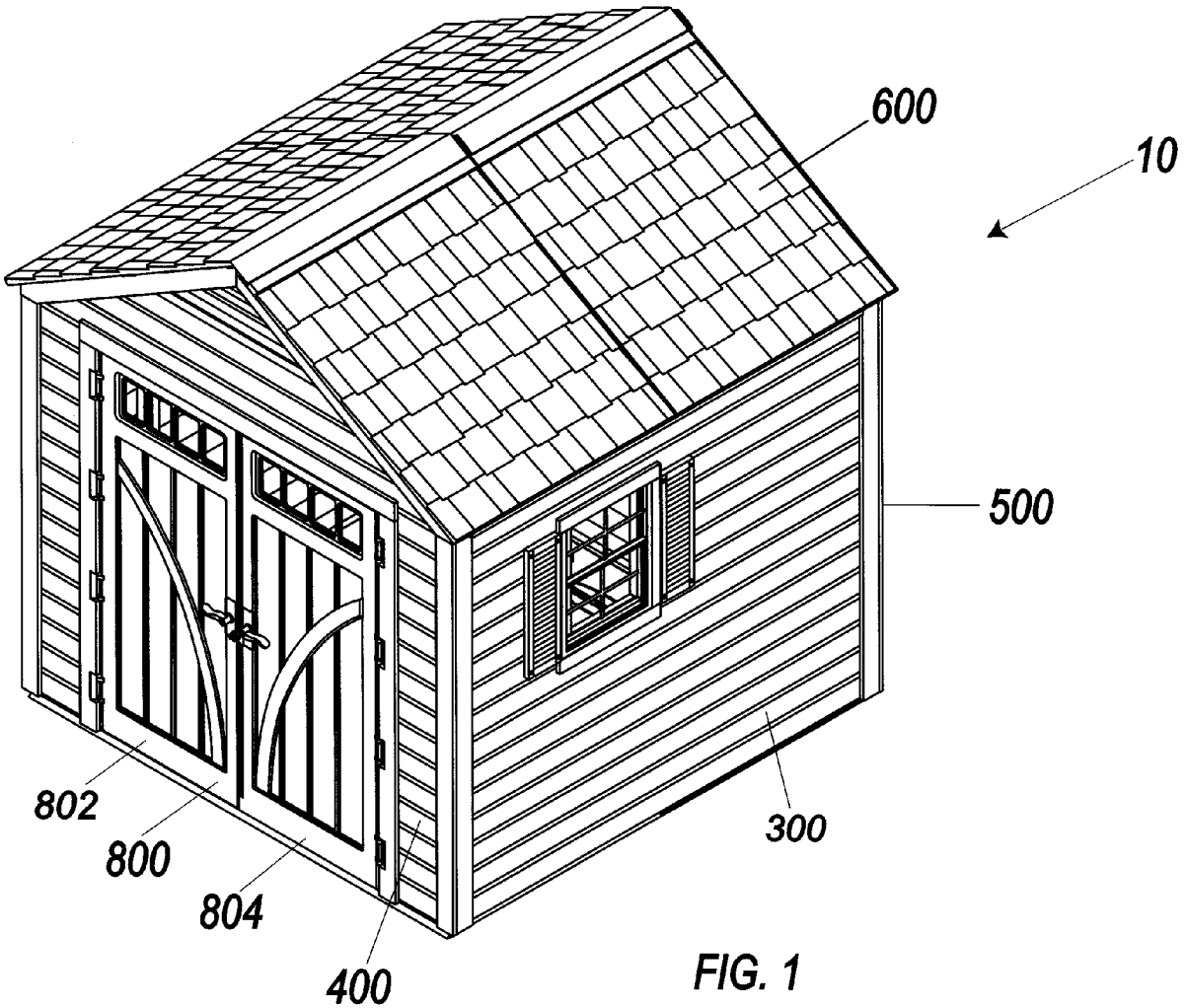
FIG. 1 is a perspective view of the enclosure of the present invention.
Figure 2:
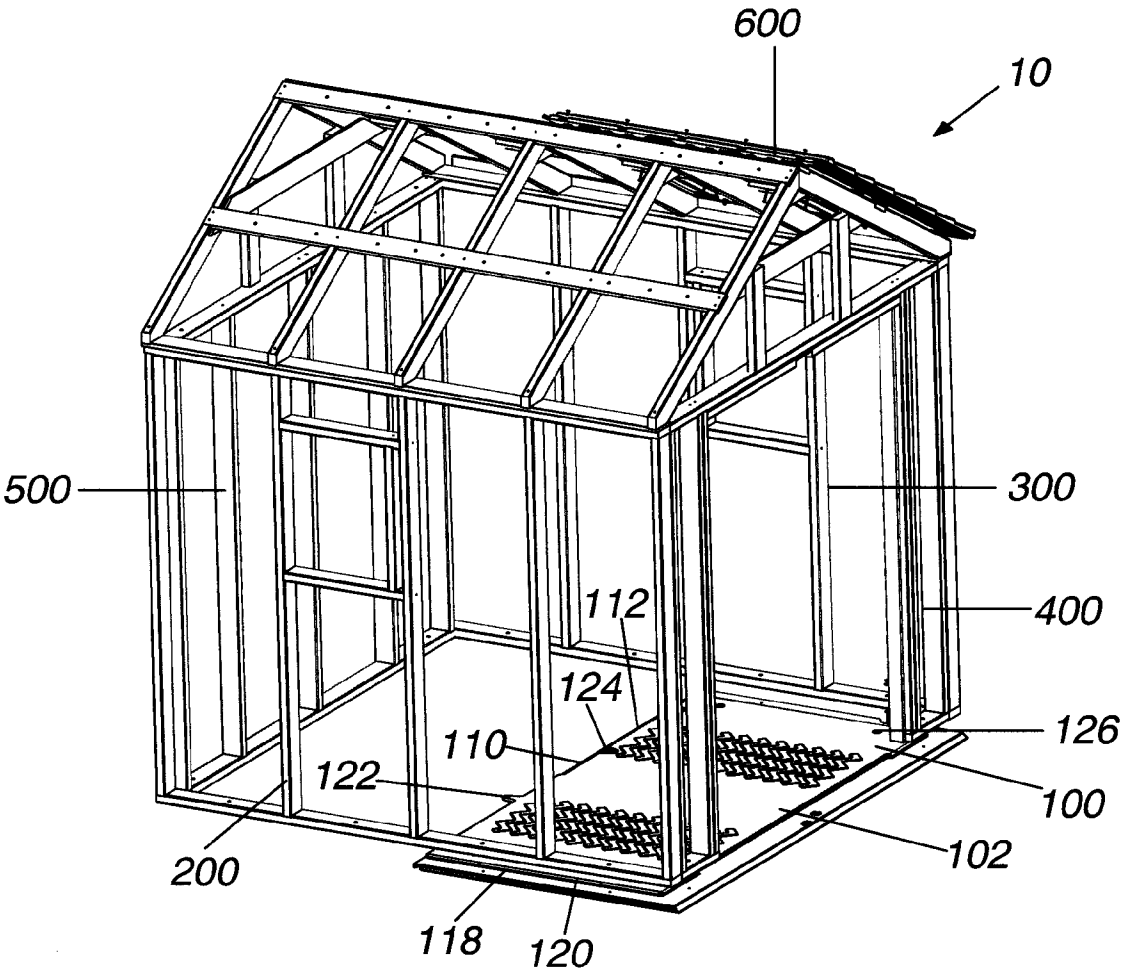
FIG. 2 is a perspective view of the frame structure of the present invention.
Figure 3:
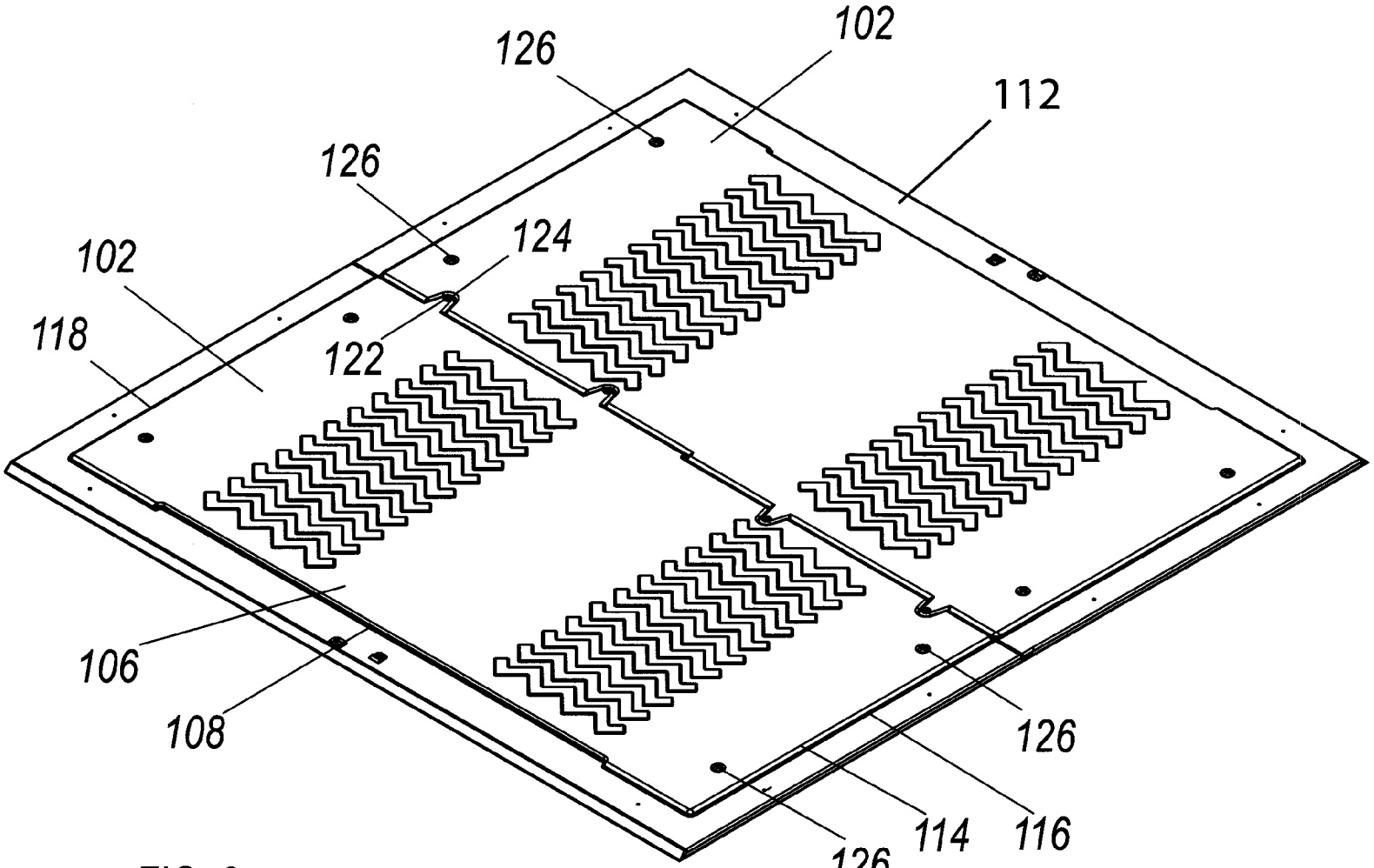
FIG. 3 is a perspective view of the floor panels of the present invention.
Figure 4:
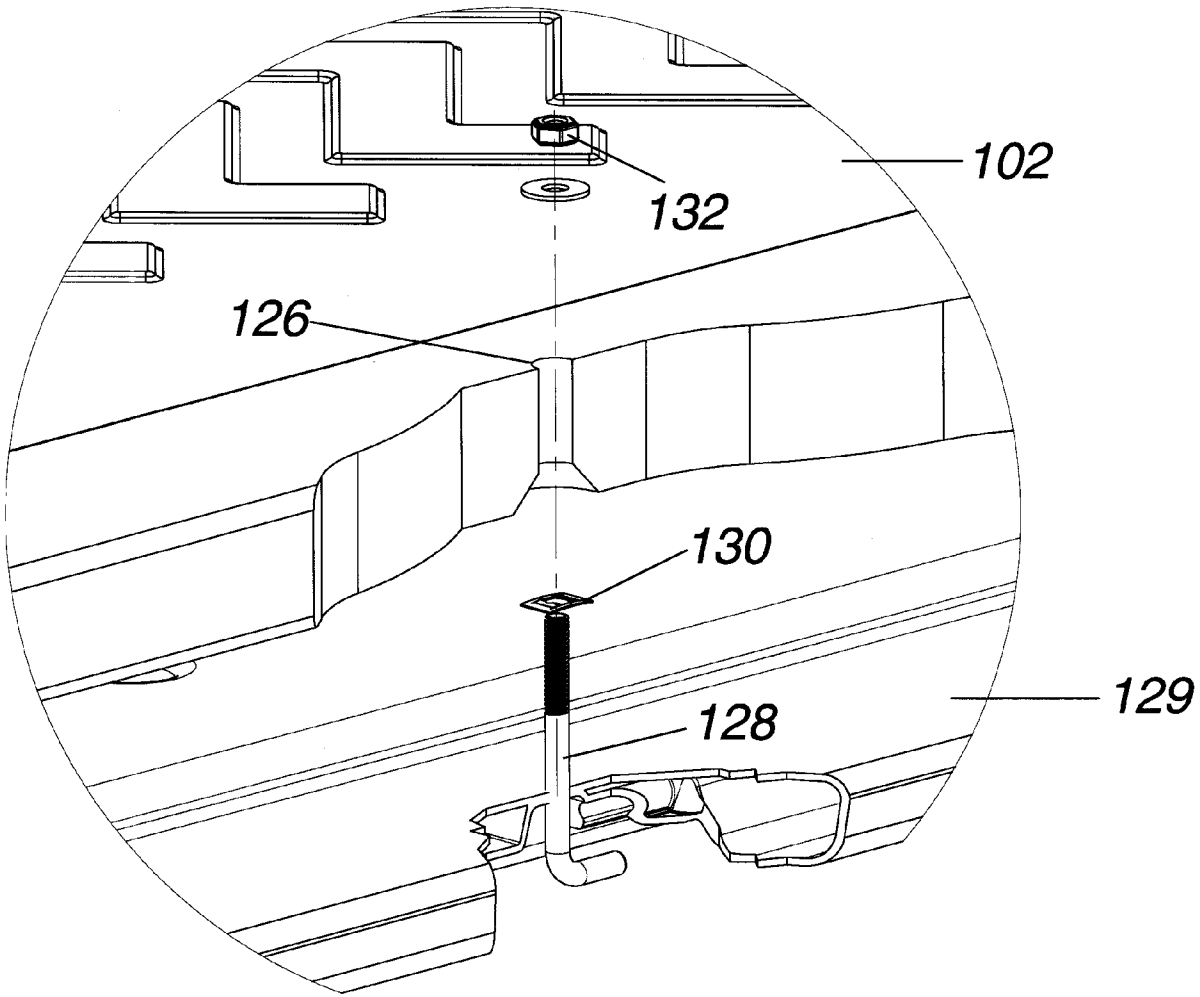
FIG. 4 is a cut away view of the connection between the floor panels and a base.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIGS. 1-43 which are now referenced, show isometric and exploded views of a utility enclosure or shed, generally referenced as 10, constructed according to a preferred embodiment of the present invention. The utility enclosure or shed includes a floor assembly 100, a left wall assembly 200, a right wall assembly 300, a front wall assembly 400, a rear wall assembly 500, and a roof assembly 600. In a preferred embodiment the front wall assembly 400 includes a door assembly 800. In a preferred embodiment the floor assembly is made from a plurality of panels. The panels are formed of but not limited to, a suitable plastic such as polystyrene, polypropylene or polyethylene.

Referring now to FIG. 1-4, the enclosure includes a floor made from one or more panels 102. Each of the floor panels further contains a front side 106 and a rear side 110 positioned opposite to and being substantially parallel to the front side 106. The panel 102 has a front side edge 108, a rear side edge 112, a right side edge 114, and a left side edge 118. The edges 108, 112, 116 and 118 define the perimeter of the floor panel.

The floor panels 102 are provided with tabs 122 and corresponding recesses 124. The tabs 122 and recesses 124 cooperate to operative hold two floor panels 102 together. Each of the tabs 122 on one of the floor panels engages a corresponding groove 124 on an adjacent floor panel in an interlocking relationship. This relationship prevents the floor panels from separating from each other during assembly of the enclosure and afterwards. The tabs 122 and recesses 124 also allow the panels to be connected to each other without the use of additional fasteners. Floor panels 102 also include a plurality of apertures 126 spaced around the perimeter of the panel. The apertures are adapted to receive fasteners 128 therein. The fasteners 128 are secured to a structure 129 beneath the floor panels. The structure can be a concrete slab, a wooden structure, a plastic structure, a composite stricture, etc. In an illustrated embodiment, in FIG. 4, an L bolt is illustrated as the fastener 128. The L bolt is secure to the structure 129 with a speed nut 130. The L bolt then passes through aperture 126 and is secured to the panel 102 with a nut 132. In addition to L bolts, other fasteners such as bolts, screws nails, etc. can be employed to secure the floor panels to an underlying support structure.

Figures 5, 6:
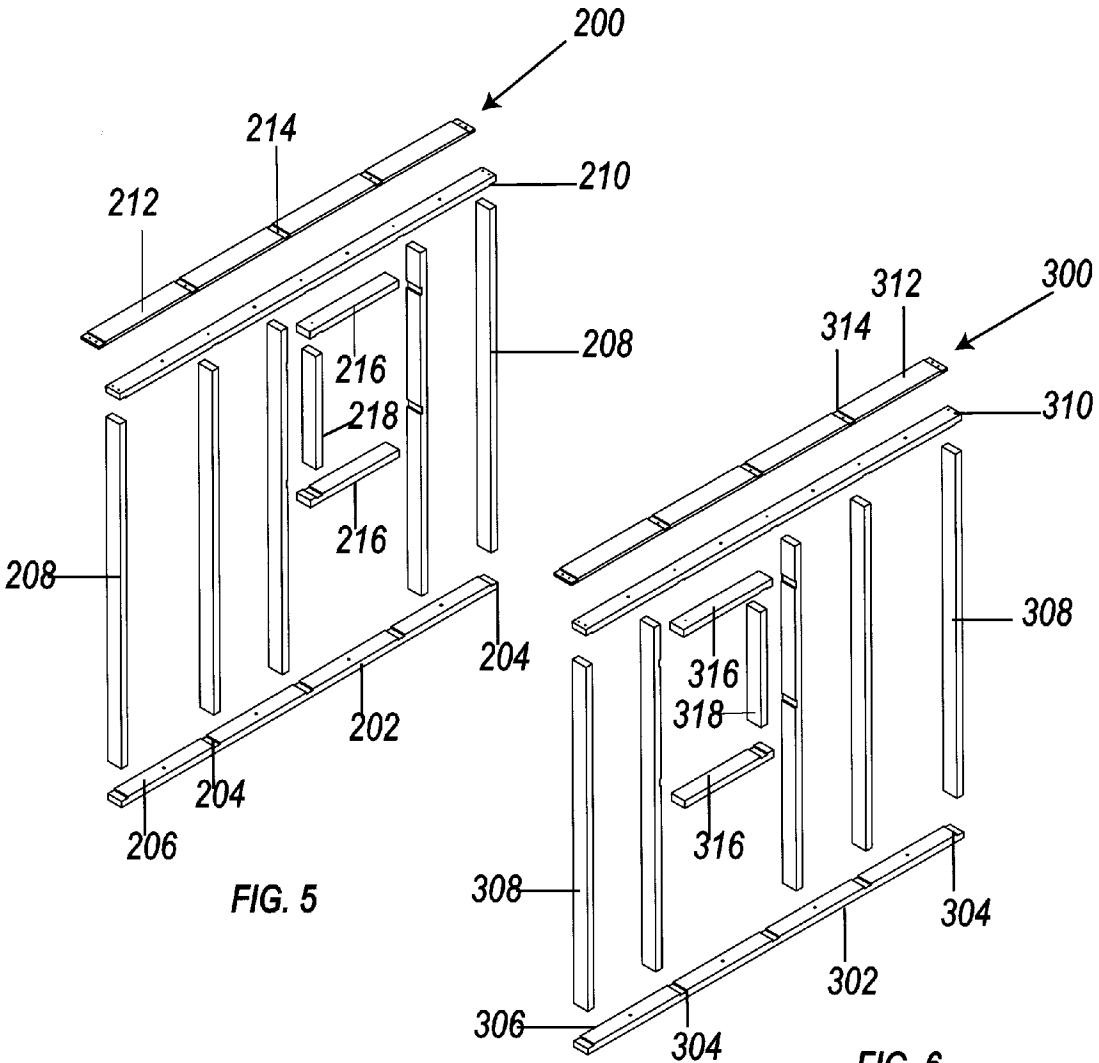
FIG. 5 is an exploded view of the left wall assembly.
FIG. 6 is an exploded view of the right wall assembly.

Left wall assembly 200 is assembled prior to being secured to floor panels 102. As illustrated in FIG. 5, a plurality of vertical members 208 are secured onto the bottom plate 202 in the precut slots 204 with fasteners (not shown). A top plate 210 is secured to the top of the vertical members 208. Top plate 210 includes a plurality of precut slots (not shown) into which vertical members are placed and secured thereto. Another plate 212 is secured to the upper surface of plate 210. Plate 212 also includes precut slots 214. Window frame header members 216 are secured between two vertical members 208, as illustrated in FIG. 5. A window side piece 218 is secured between the window frame header members 216 and it can also be secured to one of the vertical members 208. After the left wall assembly is assembled, it is secured to the floor panels 102 utilizing fasteners similar to 128 which pass through apertures 206 in bottom plate 202.

The right wall assembly 300 is similar to the left wall assembly 200. As illustrated in FIG. 6, right wall assembly 300 is assembled prior to being secured to floor panels 102. A plurality of vertical members 308 are secured onto the bottom plate 302 in the precut slots 304 with fasteners (not shown). A top plate 310 is secured to the top of the vertical members 308. Top plate 310 includes a plurality of precut slots (not shown) into which vertical members are placed and secured thereto. Another plate 312 is secured to the upper surface of plate 310. Plate 312 also includes precut slots 314. Window frame header members 316 are secured between two vertical members 308, as illustrated in FIG. 6. A window side piece 318 is secured between the window frame header members 316 and it can also be secured to one of the vertical members 308. After the right wall assembly is assembled, it is secured to the floor panels 102 utilizing fasteners similar to 128 which pass through apertures 306 in bottom plate 302.

Figures 7, 8:
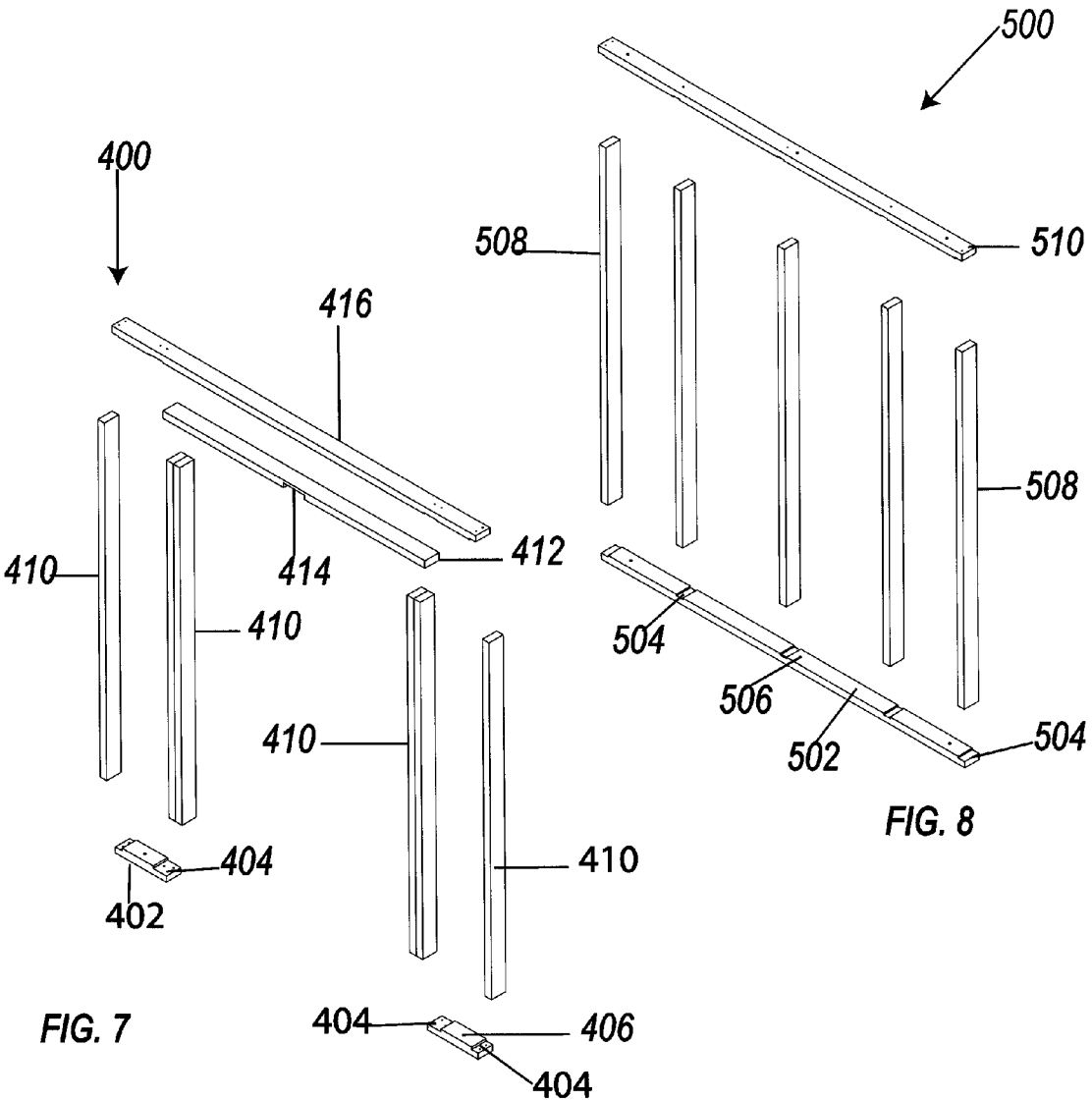
FIG. 7 is an exploded view of the front wall assembly.
FIG. 8 is an exploded view of the rear wall assembly.
Figure 9:
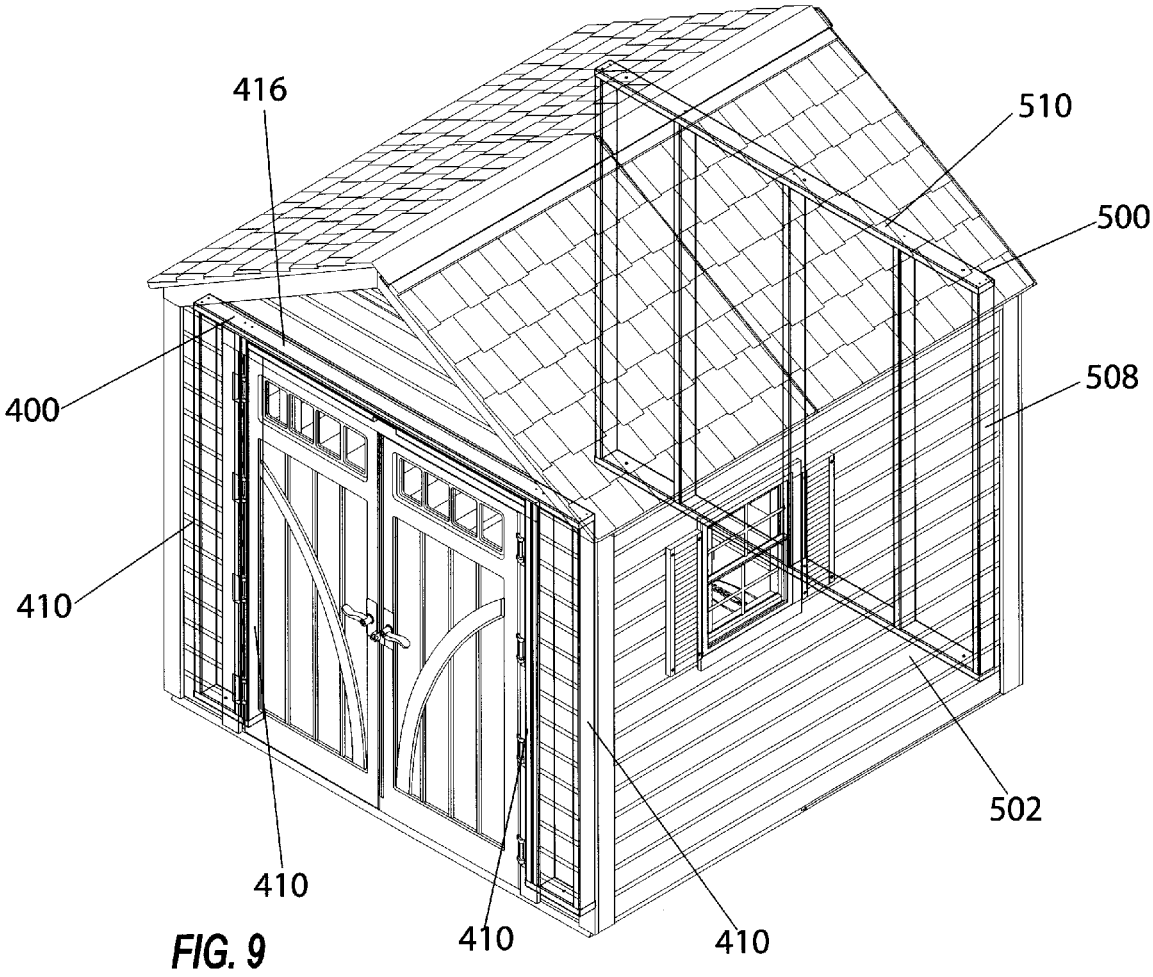
FIG. 9 is a view of the front and rear wall assembly frames in relation to the entire enclosure.
Figure 10:
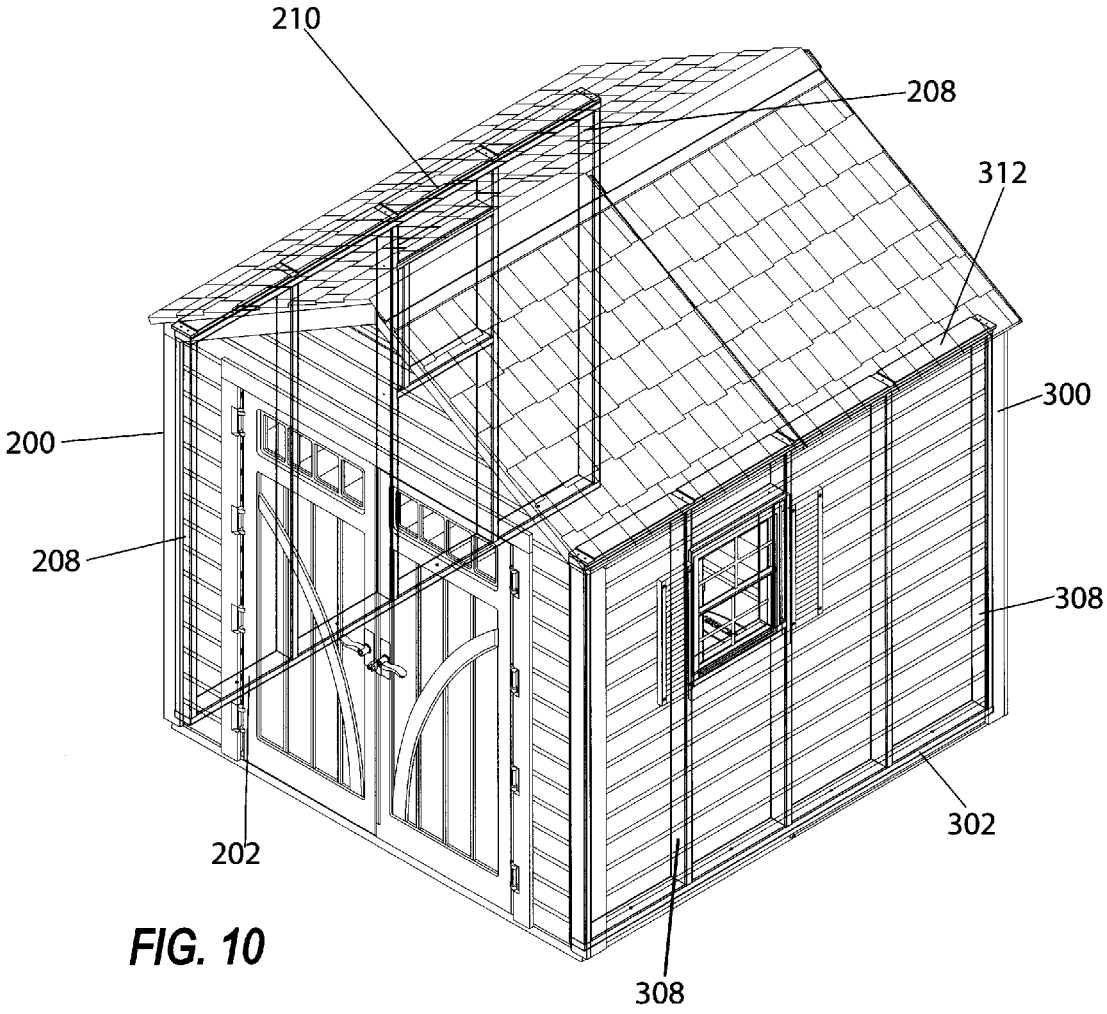
FIG. 10 is a view of the left and right wall assembly frames in relation to the entire enclosure.

The front wall assembly 400 is also assembled prior to being secured to the floor panels. As illustrated in FIG. 7, the front wall assembly includes a plurality of bottom plates 402. Each of the bottom plates includes a plurality of precut slots 404. The bottom plates also include at least one aperture 406. A plurality of vertical members 410 are secured to each of the bottom plates 402. The lower portion of each vertical member is placed in a slot 404 and then secured to the plate 402 utilizing fasteners (not shown). Two vertical members 410 are secured together on each side of the door opening. A top plate 412 is secured between the vertical members 410 adjacent the door opening. Top plate 412 includes a precut slot 414. Another top plate 416 is secured to the upper surface of top plate 412 and the tops of end vertical members 410. After the front wall assembly is assembled, it is secured to the floor panels 102 utilizing fasteners similar to 128 which pass through apertures 406 in bottom plates 402.

Rear wall assembly 500, FIG. 8, is assembled prior to being secured to the floor panels 102. The rear wall assembly includes a bottom plate 502. Plate 502 includes a plurality of precut slots 504 and apertures 506. Assembly 500 also includes a plurality of vertical members 508 secured to the bottom plate 502 in the precut slots 504. The vertical members are secured to the bottom plate 502 utilizing fasteners (not shown). A top plate 510 is secured to the tops of vertical members 508. Precut slots (not shown) are on top plate 510 to permit the correct spacing and attachment of vertical members 508. Plate 510 and members 508 are secured together with fasteners (not shown). After the rear wall assembly is assembled, it is secured to the floor panels 102 utilizing fasteners similar to 128 which pass through apertures 506 in bottom plate 502.

Figures 11A, 11B, 11C:
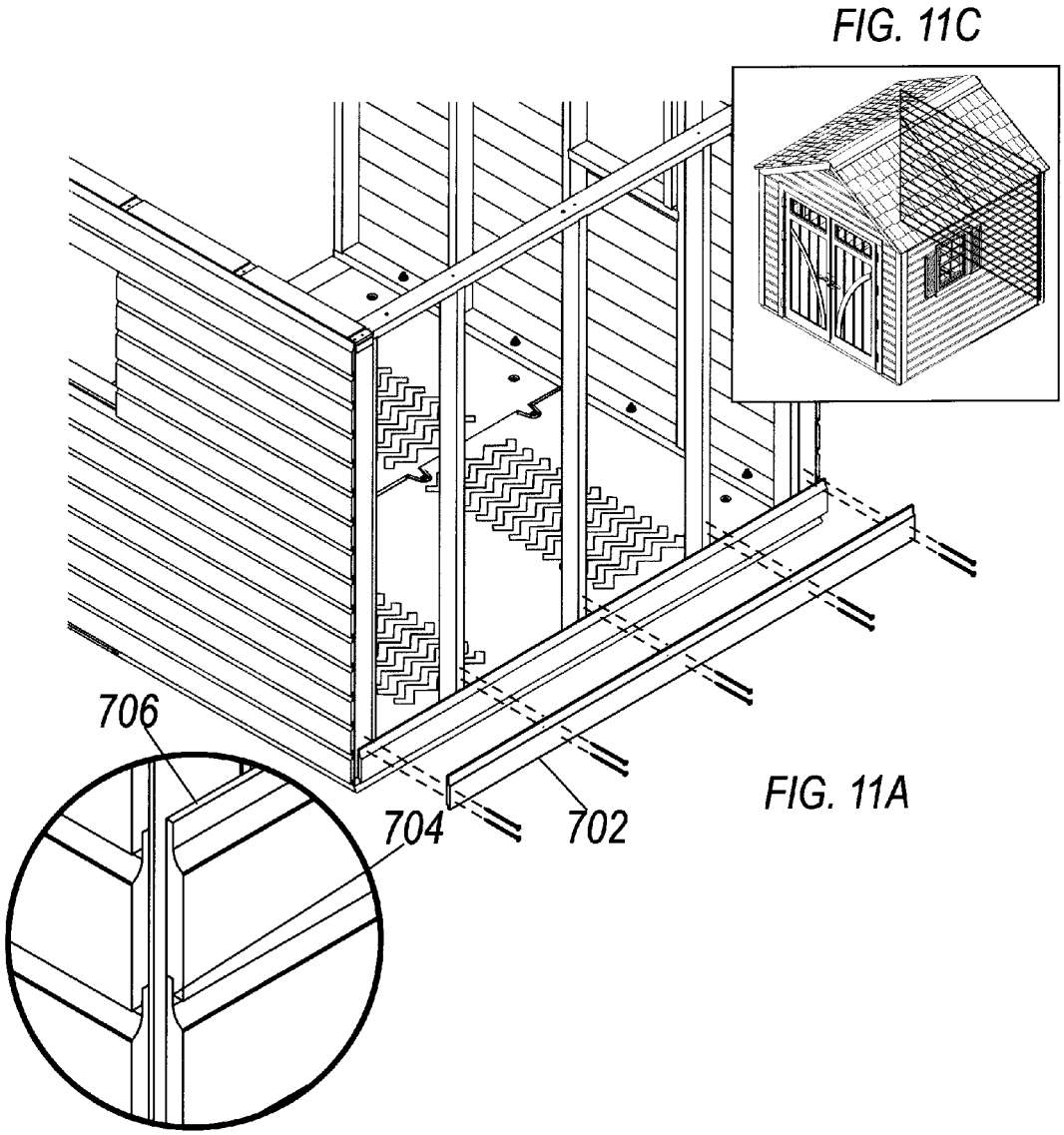
FIG. 11A is a view of the siding being installed on the rear wall.
FIG. 11B is a view of the relationship between the siding members.
FIG. 11C is a view of the rear wall with siding in relation to the entire enclosure.

Referring to FIGS. 11A-C, siding members 702 are secured to the exterior of the front, right, left and rear walls. The siding members are secured to the vertical members of the front, right, left and rear walls utilizing nails or similar fasteners, as illustrated in FIG. 11A. As illustrated in FIG. 11B the bottom of the siding members is provided with a groove 704. The top of the siding member is reduced in thickness to a relative thin portion 706. The width or thickness of portion 706 is substantially the same as the width or thickness of groove 704. This relationship enables portion 706 to be placed into groove 704 thereby interconnecting two siding members together and preventing the passage of fluids, such as water or wind, through the siding members.

Roof assembly 600 includes a plurality of roof trusses or rafters 602 secured to top plates 212 and 312 at precut slots 214 and 314 respectively. The roof trusses are secured to the plates 212 and 312 utilizing nails or other conventional fasteners. Each roof truss 602 comprises two truss members 604 secured to each other at ends 606. A gusset 608 is secured to one side of the two truss members 604 adjacent the connection of the two truss members. This gusset helps to secure the two truss members to each other.

Figure 13:
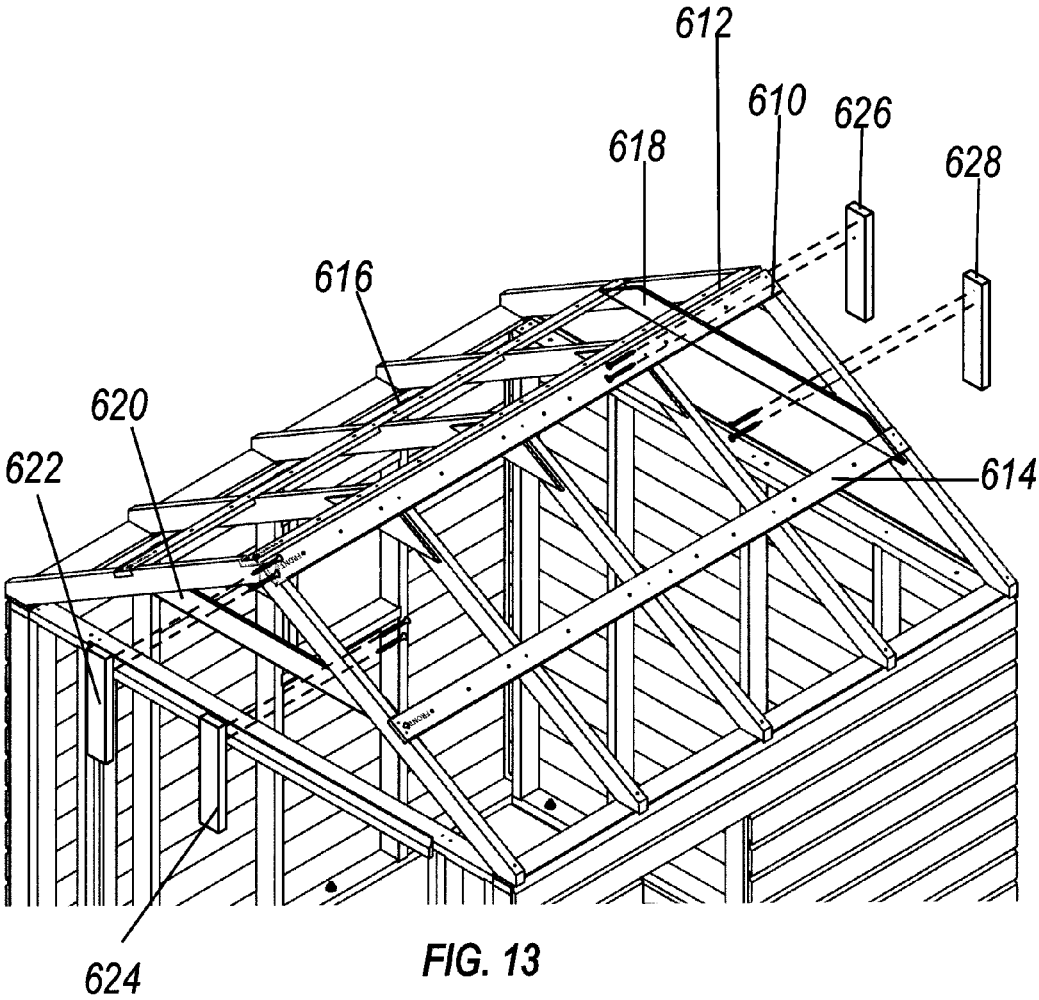
FIG. 13 is a view of the framing of the front and rear gables.
Figure 14:
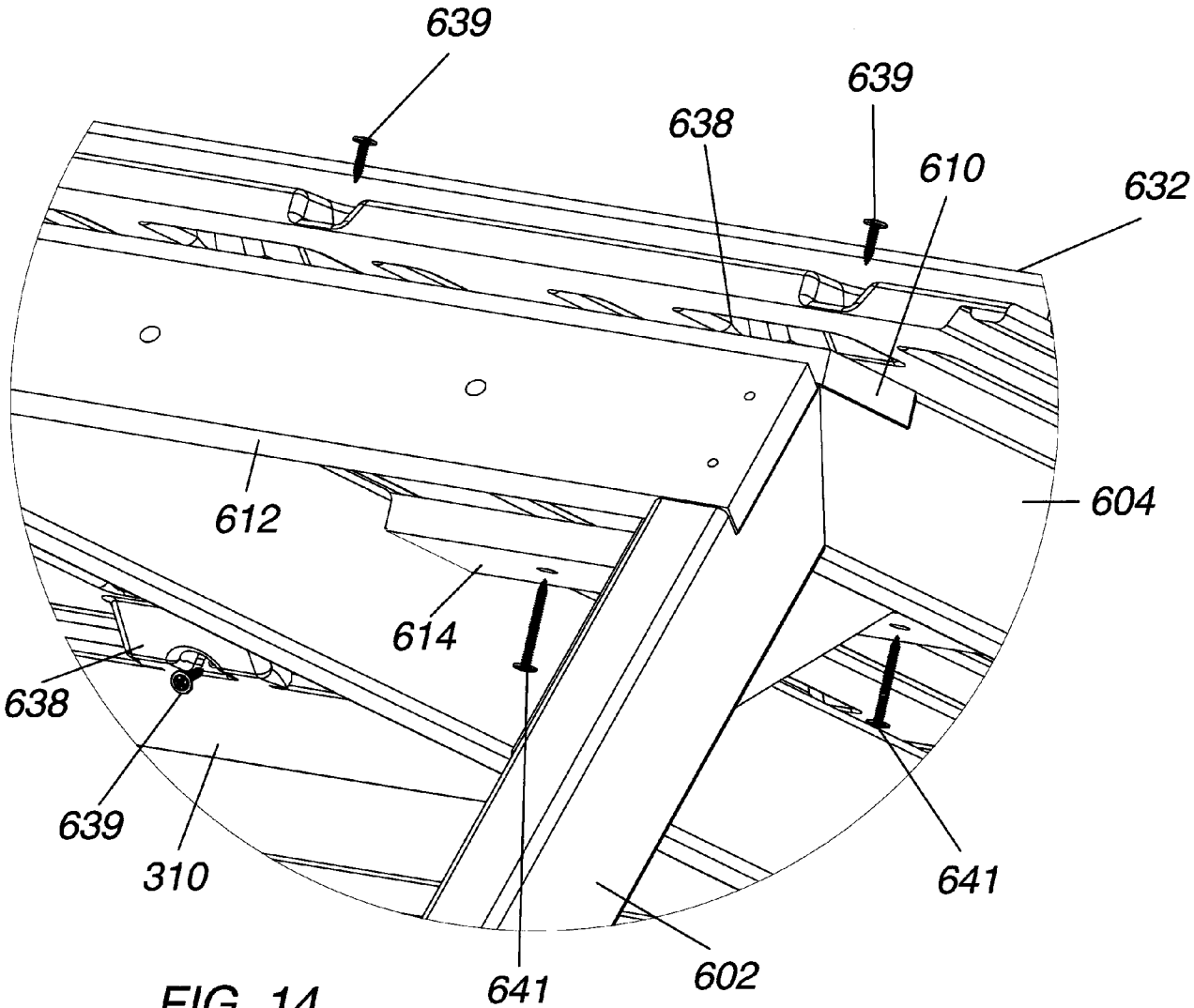
FIG. 14 is an exploded view in part of a roof panel being secured to the roof trusses.
Figures 15A, 15B, 15C:
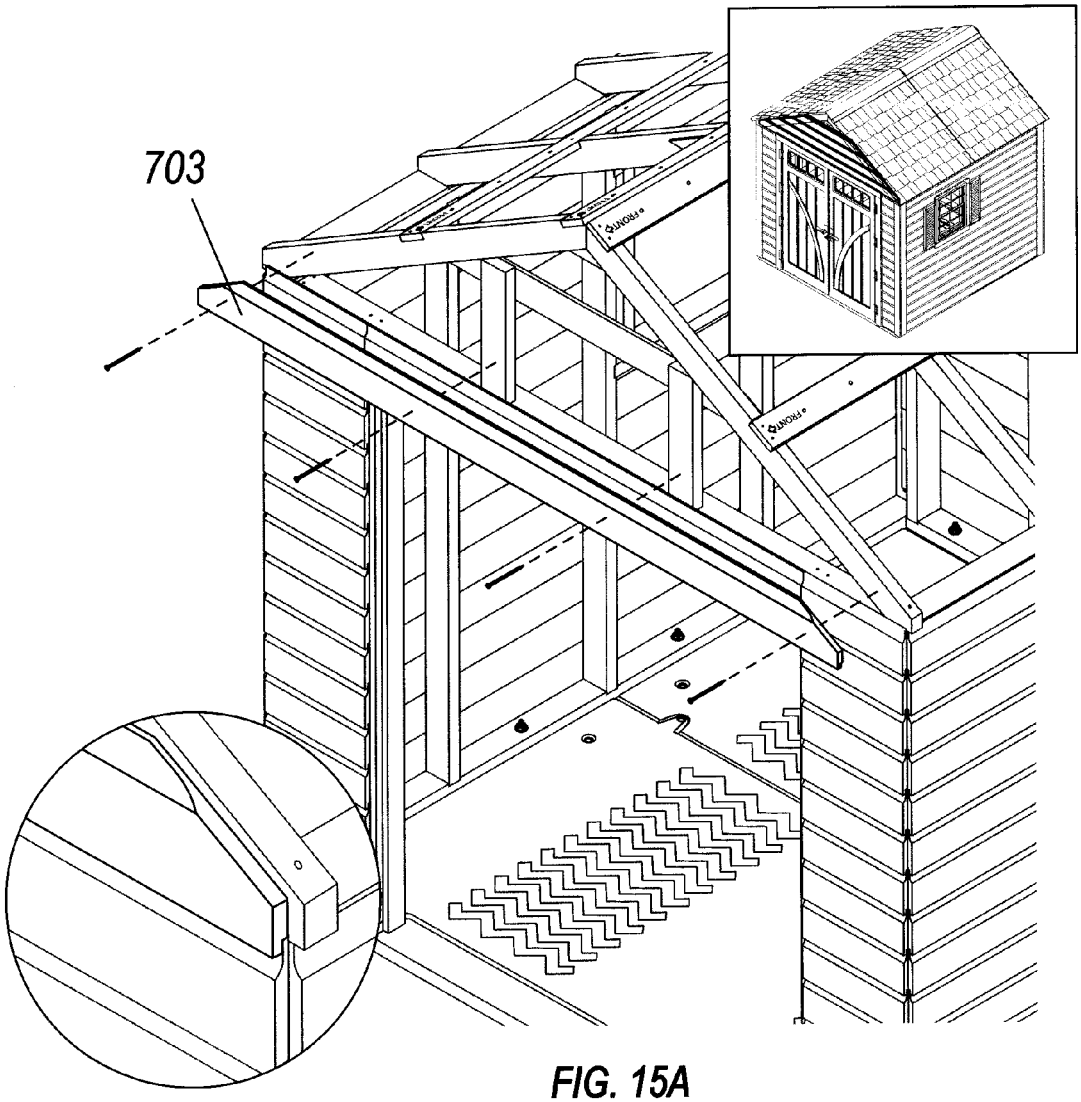
FIG. 15A is a view of the front gable siding.
FIG. 15B is a view of the front gable siding in relation to the entire enclosure.
FIG. 15C is a partial view of the end of a gable siding member in relation to the gable frame.
Figure 16A:
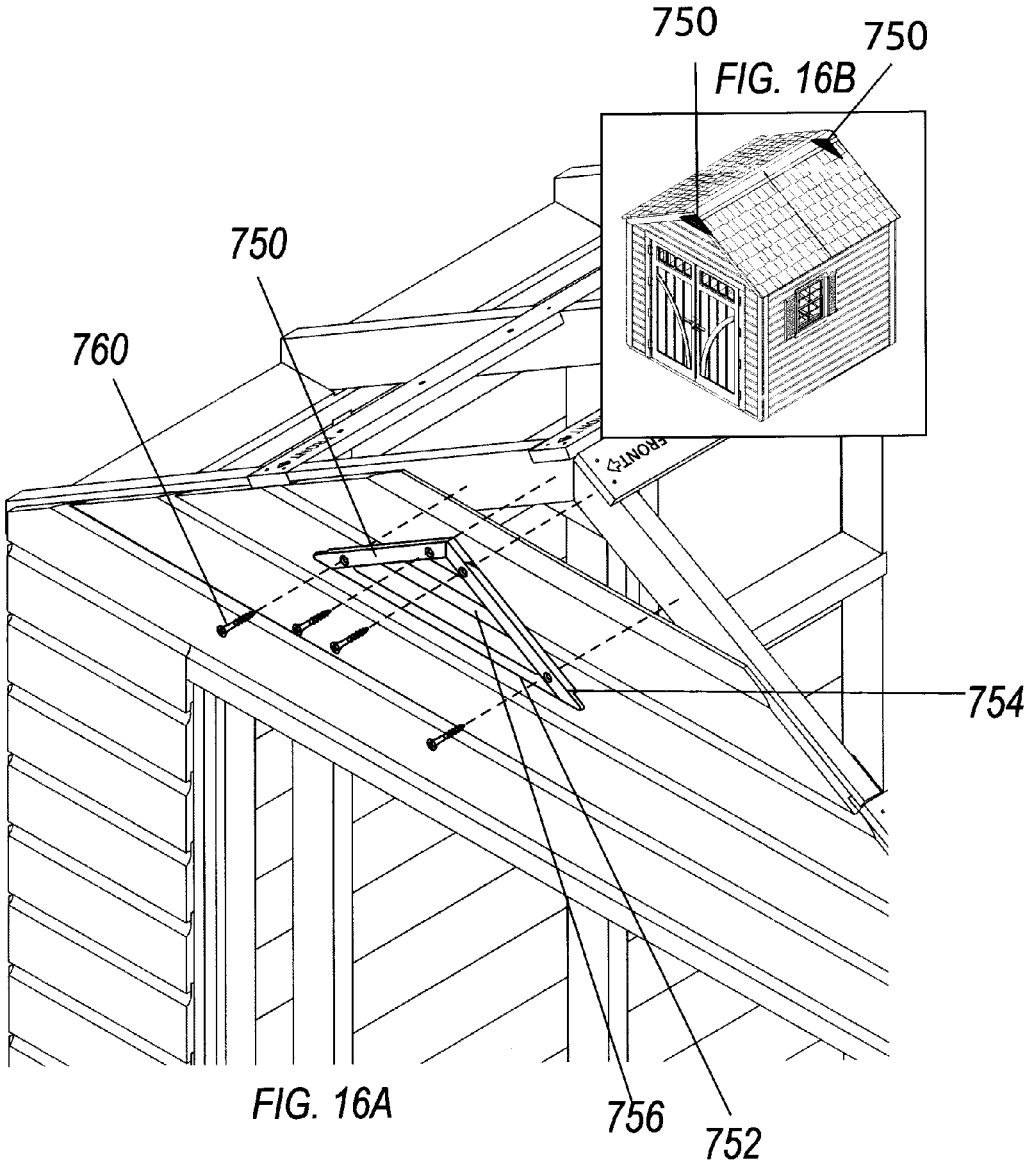
FIG. 16A is a view of a gable vent.

Two roof lathes 610 and 612 extend along the length of the roof at the peak, FIGS. 13, 14. Additional roof lathes 614 and 616 extend the length of the roof at approximately the midpoint of the length of each roof truss. The roof lathes 610-616 connect the roof trusses to each other and thereby form the roof. The roof lathes are preferably secured to the roof trusses using screws and predrilled holes in the lathes and roof trusses. This assures a correct and accurate positioning of the roof members without the need for measurements.

On the end roof trusses, gable braces 618 and 620 are secured between truss members 602 and 604 on the inside thereof. The gable braces are secured to the truss members at approximately the point where the roof lathes are secured to the truss members, as seen in FIG. 13. Gable bracing members 622 and 624 are secured between gable brace 620 and the top plates 414, 416 of the front wall assembly. This provides structural support and rigidity for the front gable. The rear gable is constructed in a similar manner. Gable bracing members 626 and 628 are secured between gable brace 618 and the top plate 510 of the rear wall assembly.

Siding members 703 are secured to the front and rear gables. The siding members 703 which are secured to the gables are precut to specific sizes. These precut sizes correspond to the taper or slope of the roof. This enables the siding members 703 to be installed on the gables, in line with the roof line, without cutting the ends of the siding members. The siding members are secured to the roof trusses using conventional fasteners. The siding members 703 on the gables are also provided with grooves similar to 704 and they have a relative thin top portion similar to 706, on siding members 702. This enables the siding members to be assembled in an overlapping relationship which prevents the passage of wind and rain through the siding members and into the enclosure.

Figure 17:
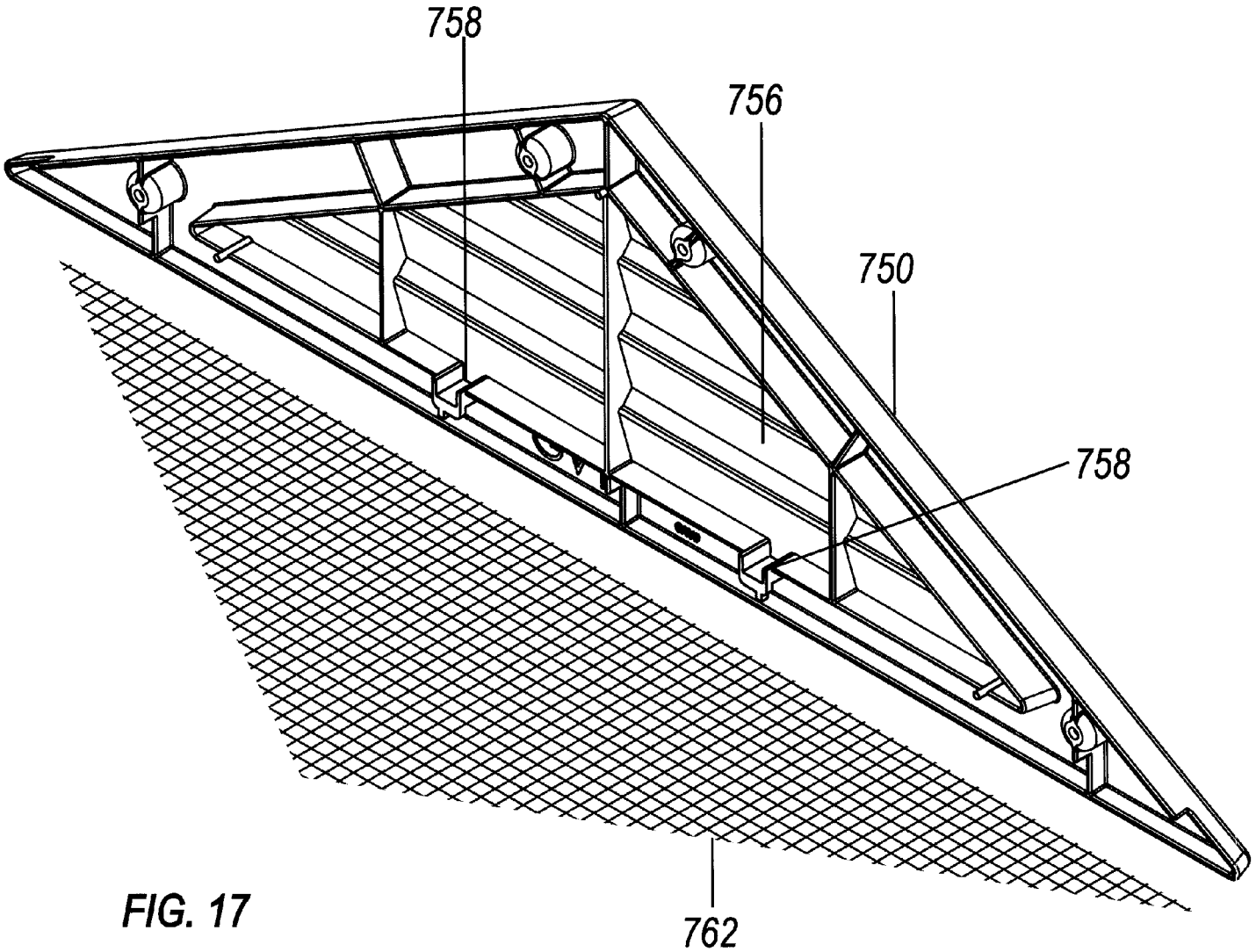
FIG. 17 is a rear view of the gable vent and screen.

At the peak of each gable is a vent 750. Preferably there are two vents 750, one at the peak of each gable in the front and rear of the enclosure, FIGS. 16A and 16B. This enables air to flow through the enclosure. FIG. 17 is an enlarged view of each of the gable vents 750. The front of each vent includes a frame 752. The frame comprises three outer frame members 754 which are secured together in a triangular configuration to form the outer perimeter of the gable vent. A plurality of slats or horizontal members 756 are secured between the frame members 754. The slats are preferably mounted in an overlapping relation to each other to permit wind to pass through the vent, but stop water or rain from passing through the vent. The slats 756 are also mounted in an angled relationship to the vertical. A plurality of hooks 758 are secured to the vent. These hooks engage the top portions 706 of the siding members 702 to help secure the vents to the enclosure. Additionally, fasteners 760 which pass through apertures in the vents secure the vents to the roof trusses 602, 604, FIG. 16A. A screen 762 is secured to the rear of each of the vents 750. Screen 762 prevents the incursion of insects and other undesirable elements into the enclosure.

Figures 18A, 18B:
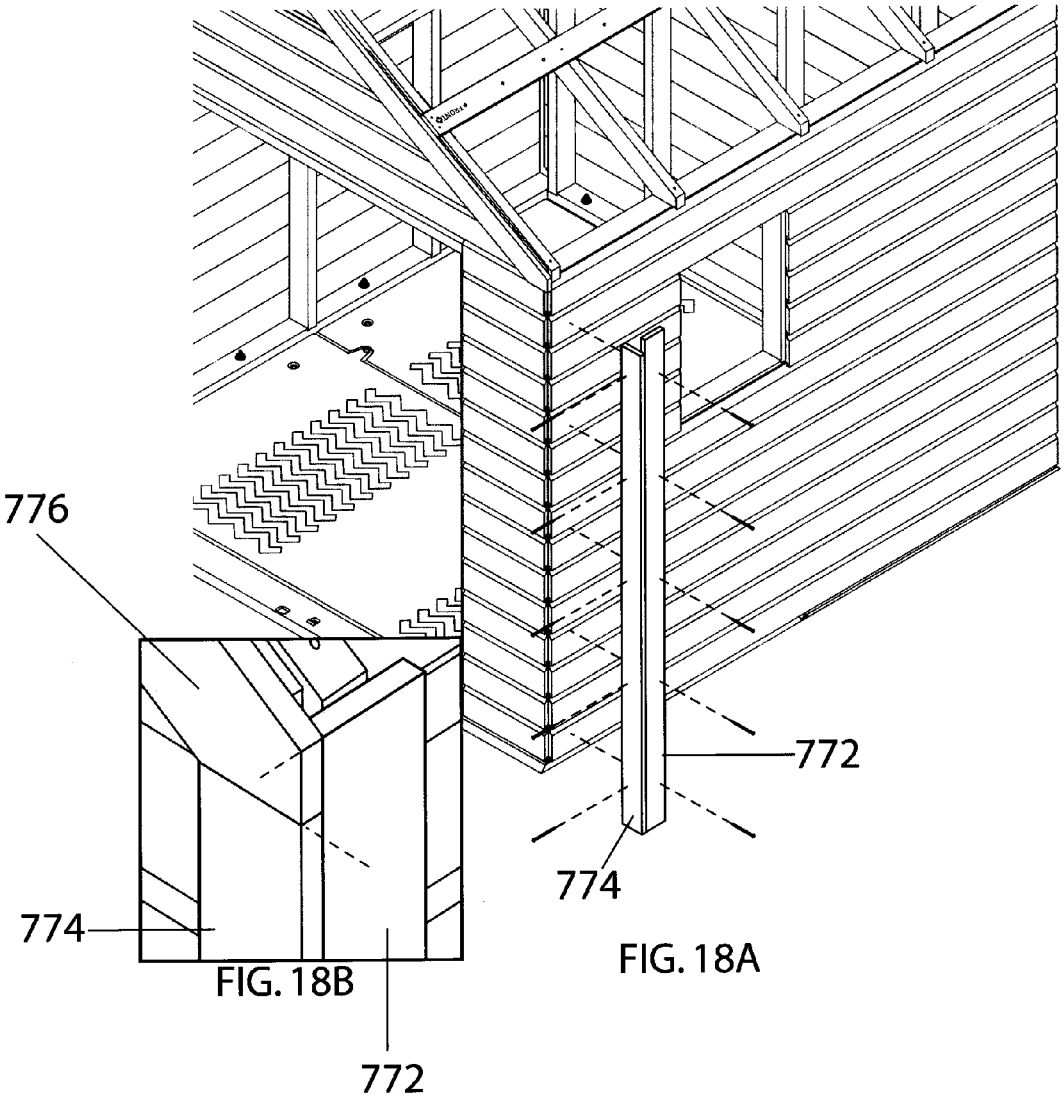
FIG. 18A is a view of the corner trim.
FIG. 18B is a view of an enlarged section of FIG. 18A.
Figure 19:
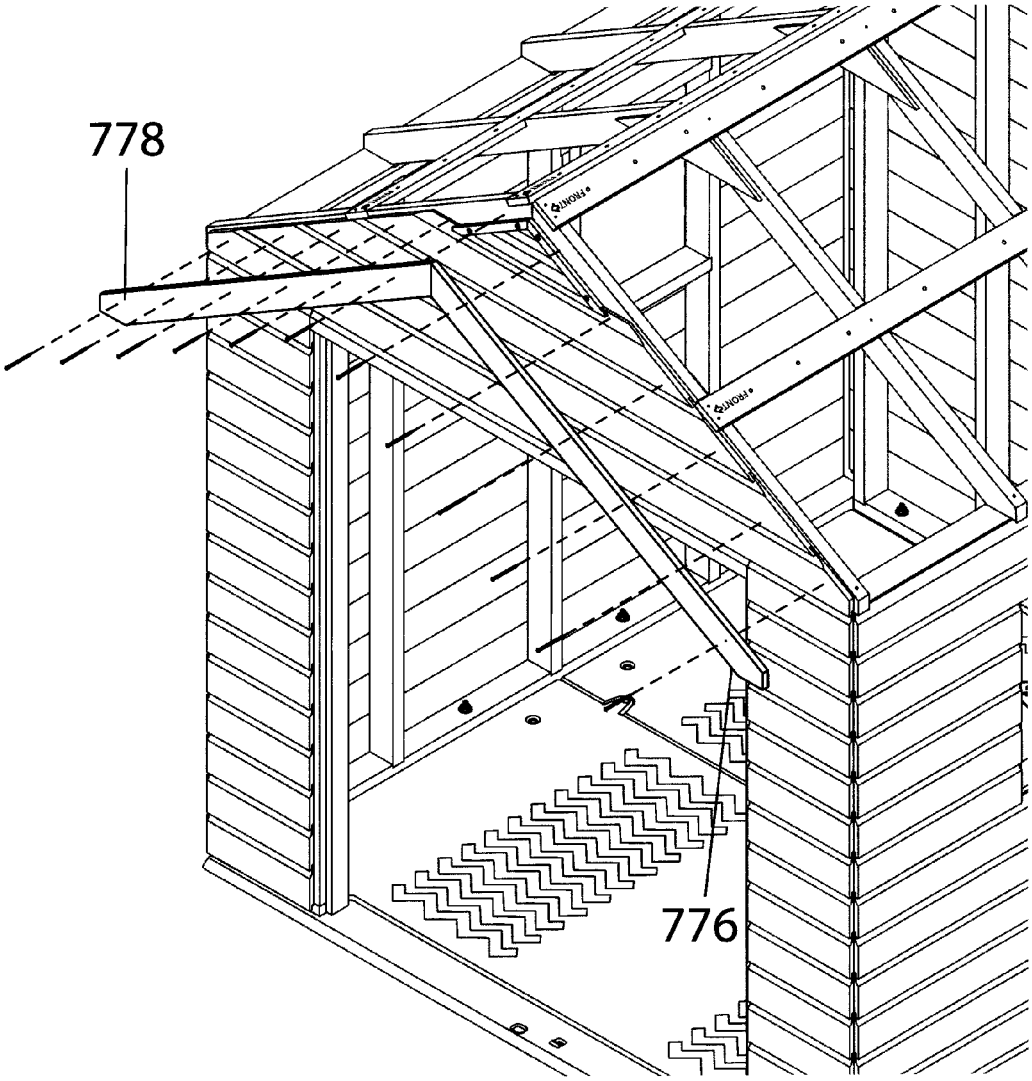
FIG. 19 is a view of the gable trim members.
Figure 20:
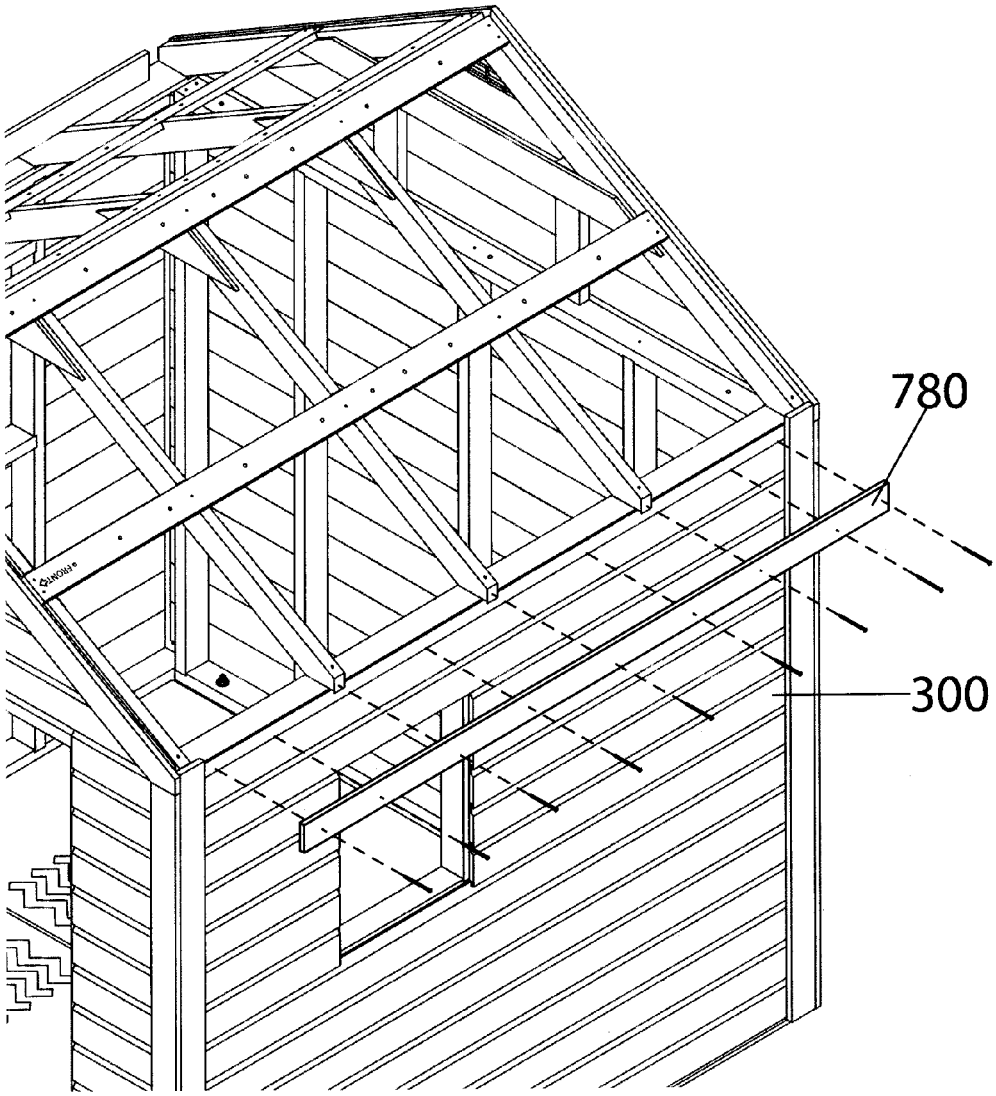
FIG. 20 is a view of the fascia boards.

FIGS. 18A and 18B illustrate the corner trim members 772 and 774. These trim members are secured to each of the corners of the enclosure and cover the ends of the siding members 702. This ensures an aesthetically pleasing appearance for the corners of the enclosure. The length of corner trim member 774 is slightly shorter than trim member 772 since it abuts the gable trim member 776, FIG. 18B. Gable trim members 776 and 778, FIG. 19, are secured to truss members 602, 604 and gable siding member 703. Gable trim members 776 and 778 are secured to the front and rear gables. Fascia member 780, FIG. 20, is secured to the upper portion of each of the left and right wall assemblies 300 and 200.

Figure 21:
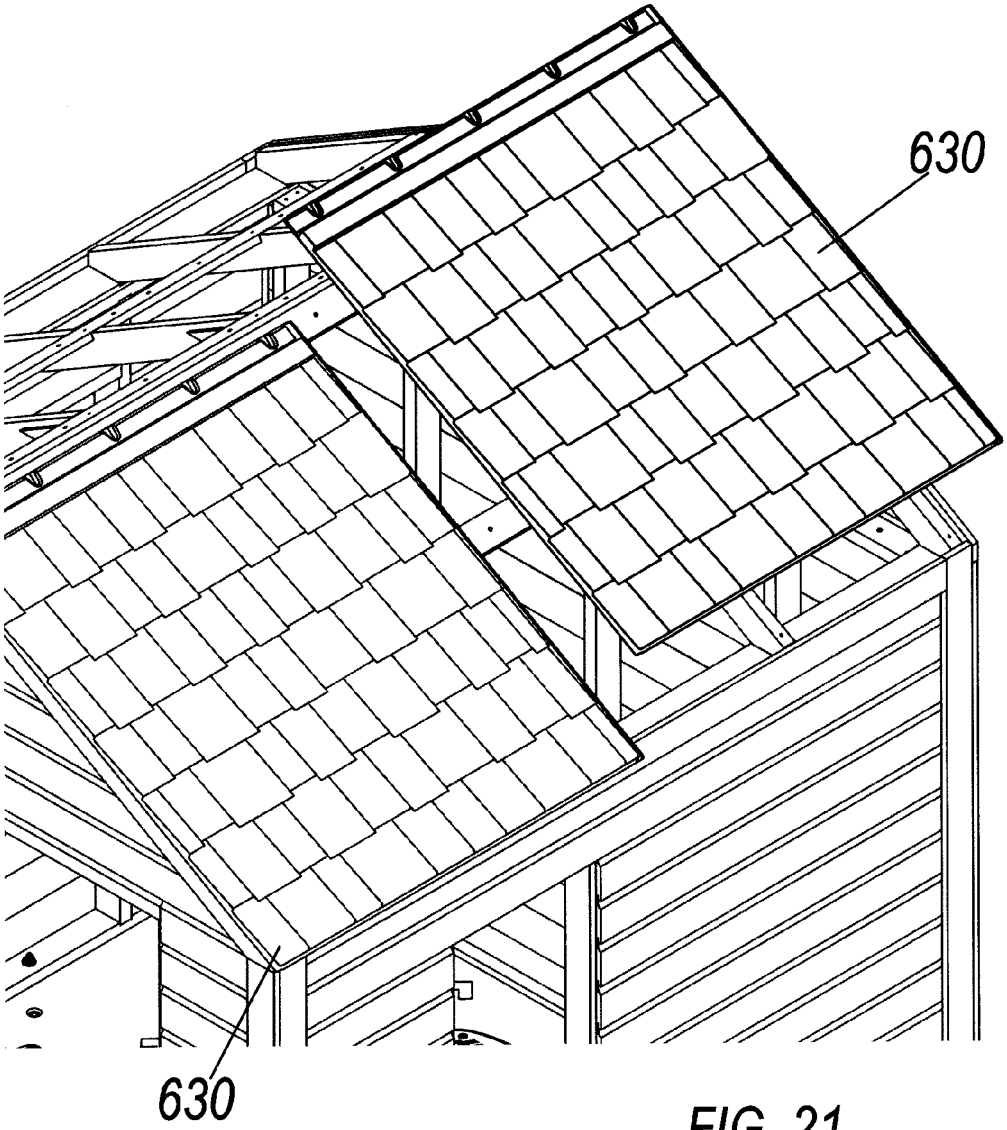
FIG. 21 is a view of the roof panels.
Figure 22:
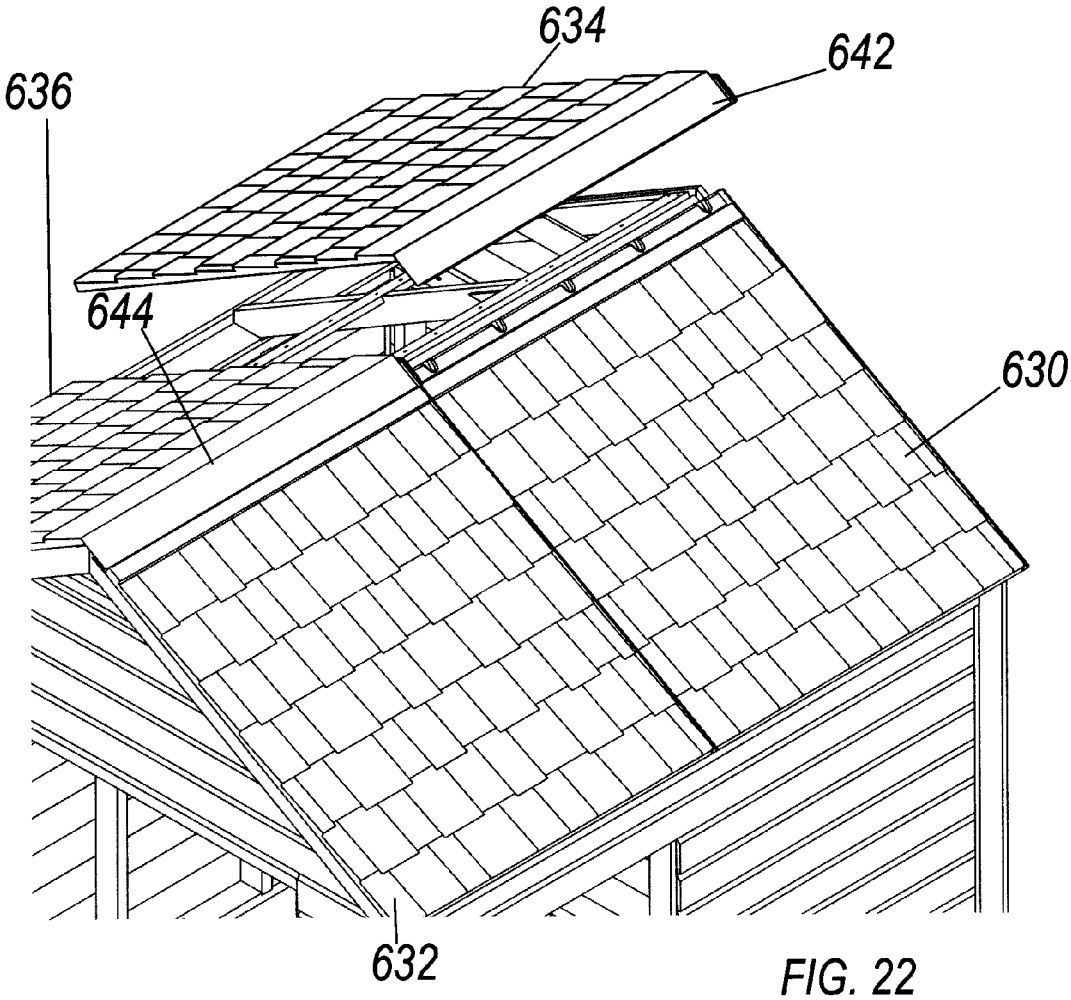
FIG. 22 is another view of the roof panels.
Figure 23:
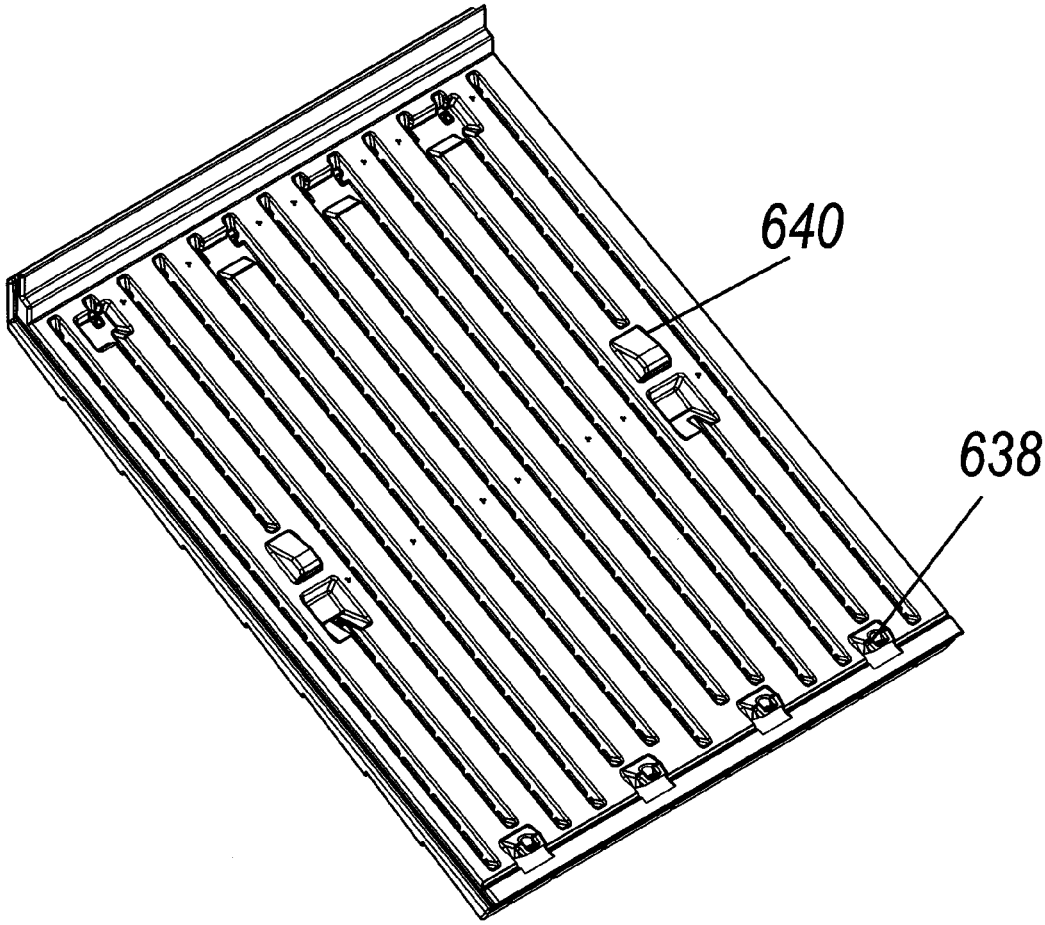
FIG. 23 is a view of the underside of a roof panel.

The roof is covered by a plurality of panels 630, 632, 634 and 636. The panels are preferably plastic, but could be formed from any other material that would repel rain and other elements of the weather. As illustrated in FIGS. 21 and 22, the roof panels 630 and 632 are installed on the roof trusses first. The underside of each of the roof panels is provided with a plurality of positioning and fastening members 638 and 640, FIG. 23. Positioning and fastening members 638 abut the fascia board 780 and provide a structural point at which the roof panel can be secured to the fascia board with conventional fasteners, such as screws. Positioning and fastening members 640 are located at the midpoint of the length of the roof panels. These positioning and fastening members provide a structural support at which the roof panel can be secured to the roof lathes 614, 616. The top portion of the roof panels are also secured to the roof lathes 610, 612 utilizing fasteners. FIG. 14 illustrates the manner in which the roof panels are secured. Roof panel 632 is installed first on the roof trusses and fastened to the roof lathes by fastener screws 639 along the upper fastening member 638 and lower fastening member 638 to top plate 310. Center placed roof lathe 614 is further secured by fastener 641. Roof panel 630 can then be installed.

Figure 24:
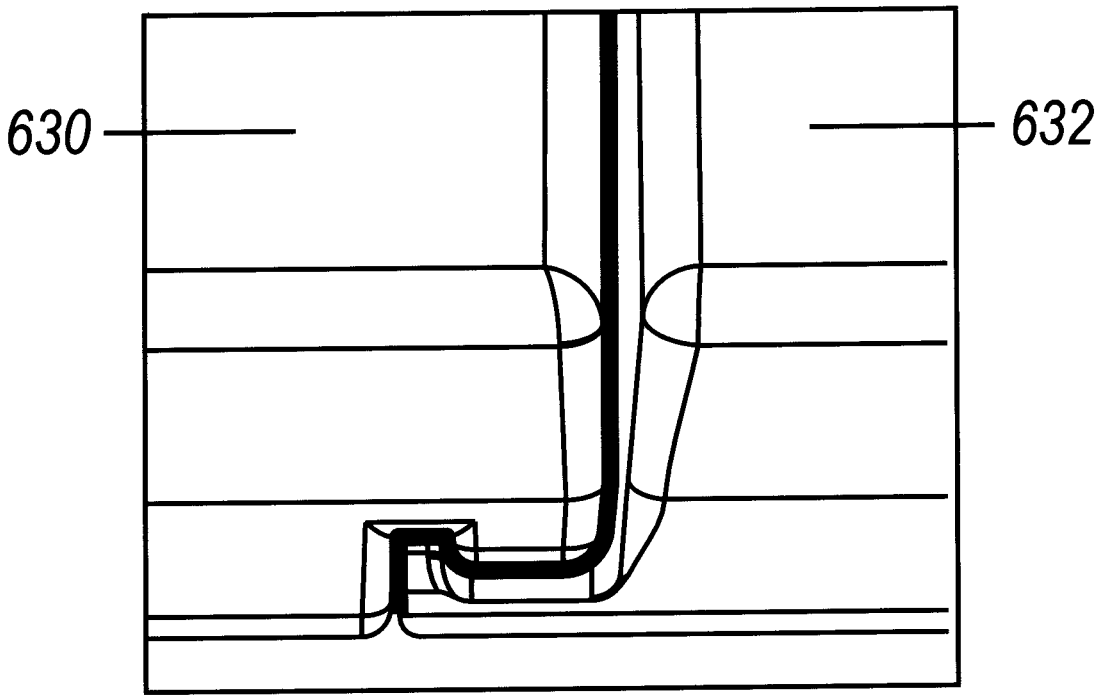
FIG. 24 is a cross section view of the connection between two adjacent roof panels.

The panels 630 and 632 are provided with an interlocking connection, as illustrated in FIG. 24. This interlocking connection prevents the passage of water and other elements of the weather between the roof panels. There is also the same interlocking connection between panels 634 and 636. Roof panels 634 and 636 are provided with a ridge cap 642 and 644 respectively. These ridge caps extend over the top ends of roof panels 630 and 632. They prevent the passage of water and other elements of the weather through the junction of the top portions of all of the roof panels.

Figure 25:
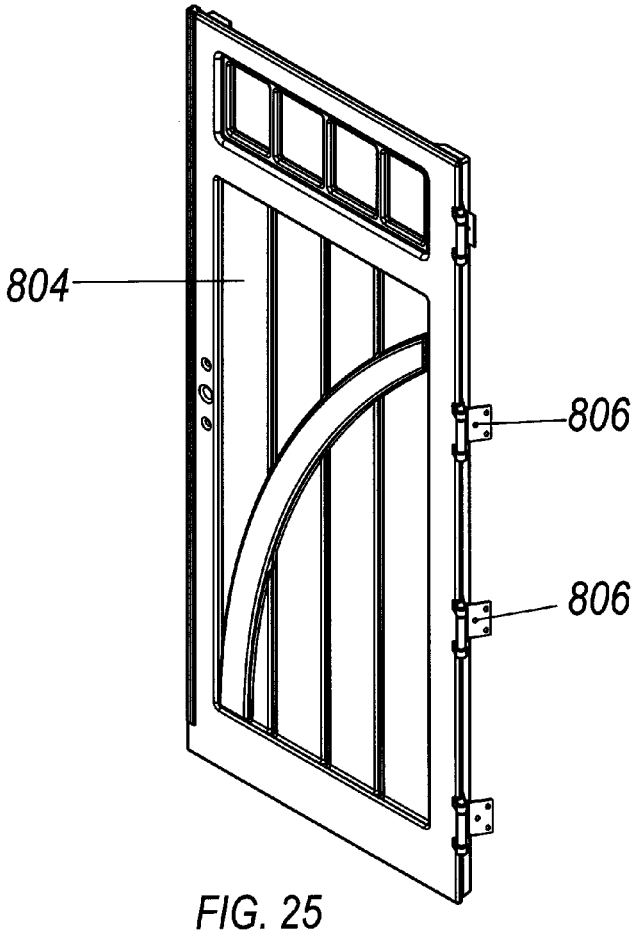
FIG. 25 is a view of the right door.
Figure 26:
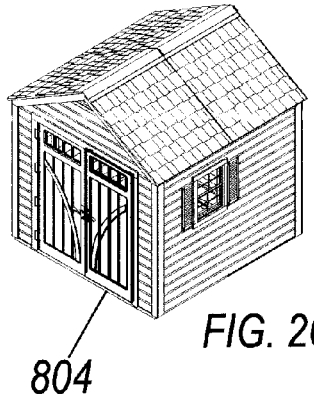
FIG. 26 is a view of the right door in relation to the entire enclosure.
Figure 27:
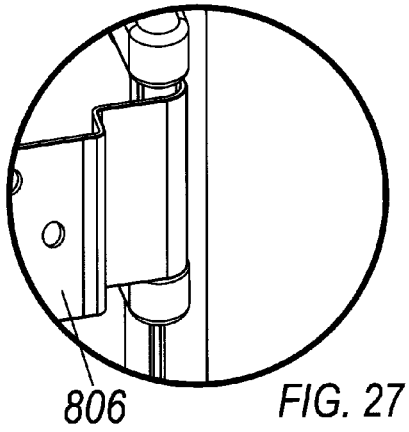
FIG. 27 is a view of a door hinge.
Figure 28:
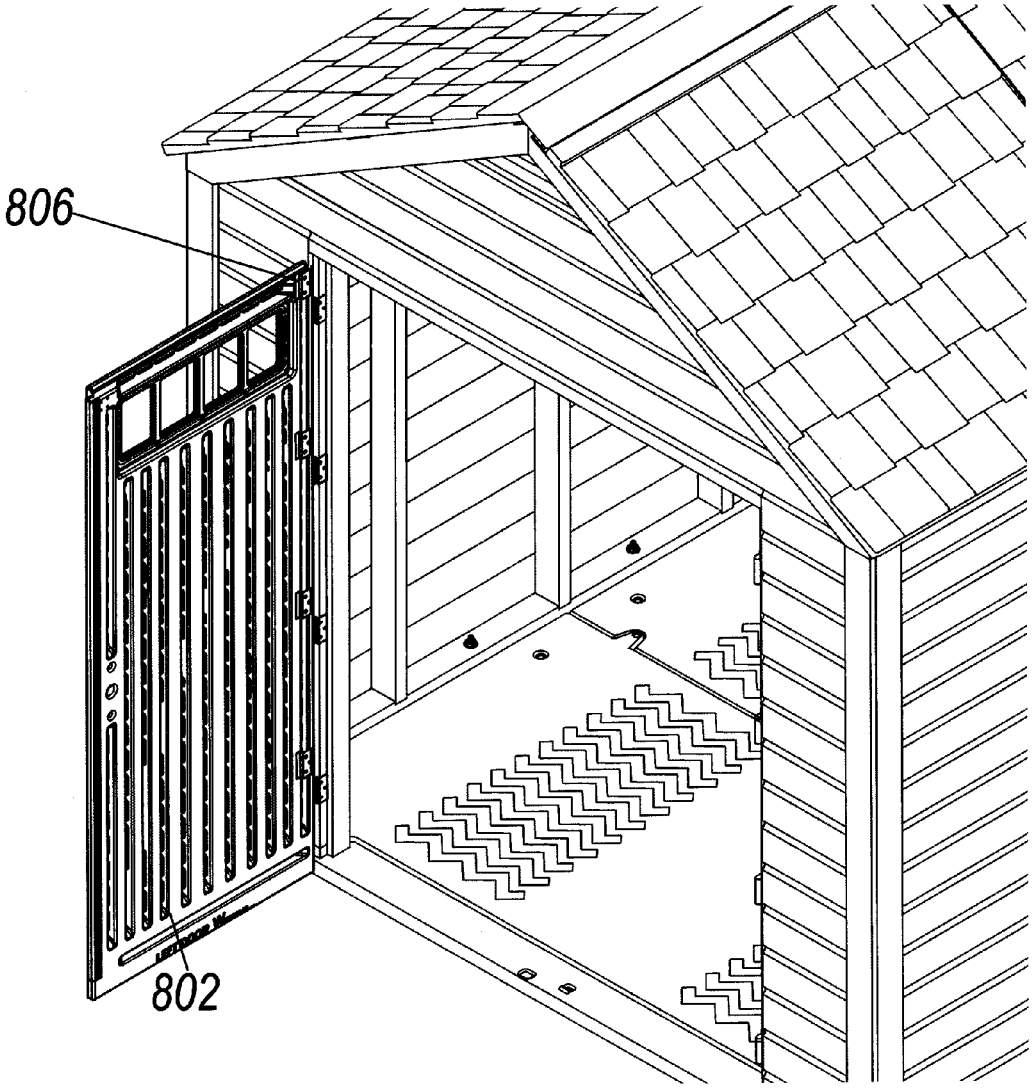
FIG. 28 is a view of the left door.
Figure 29:
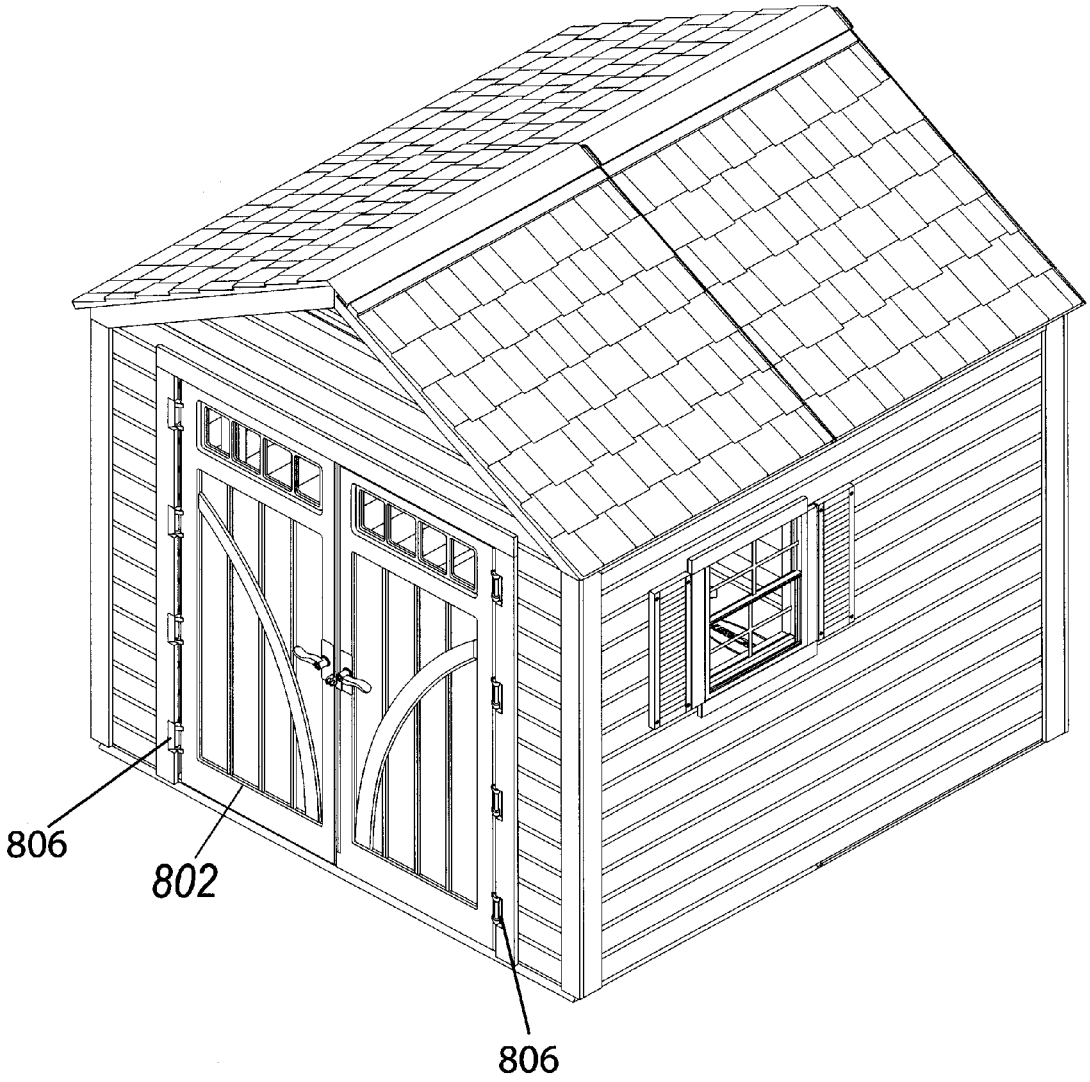
FIG. 29 is a view of the left door in relation to the entire enclosure.
Figure 30:
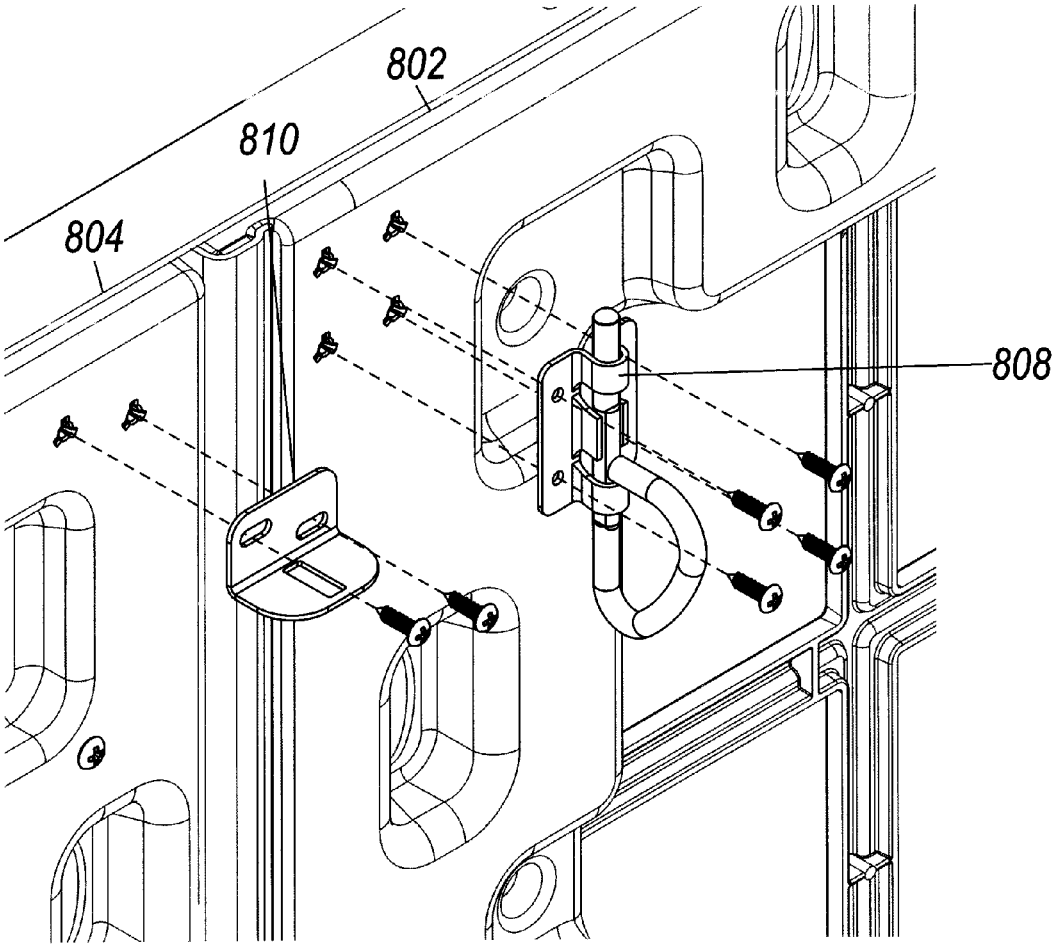
FIG. 30 is a view of the upper door latching members.
Figure 31:
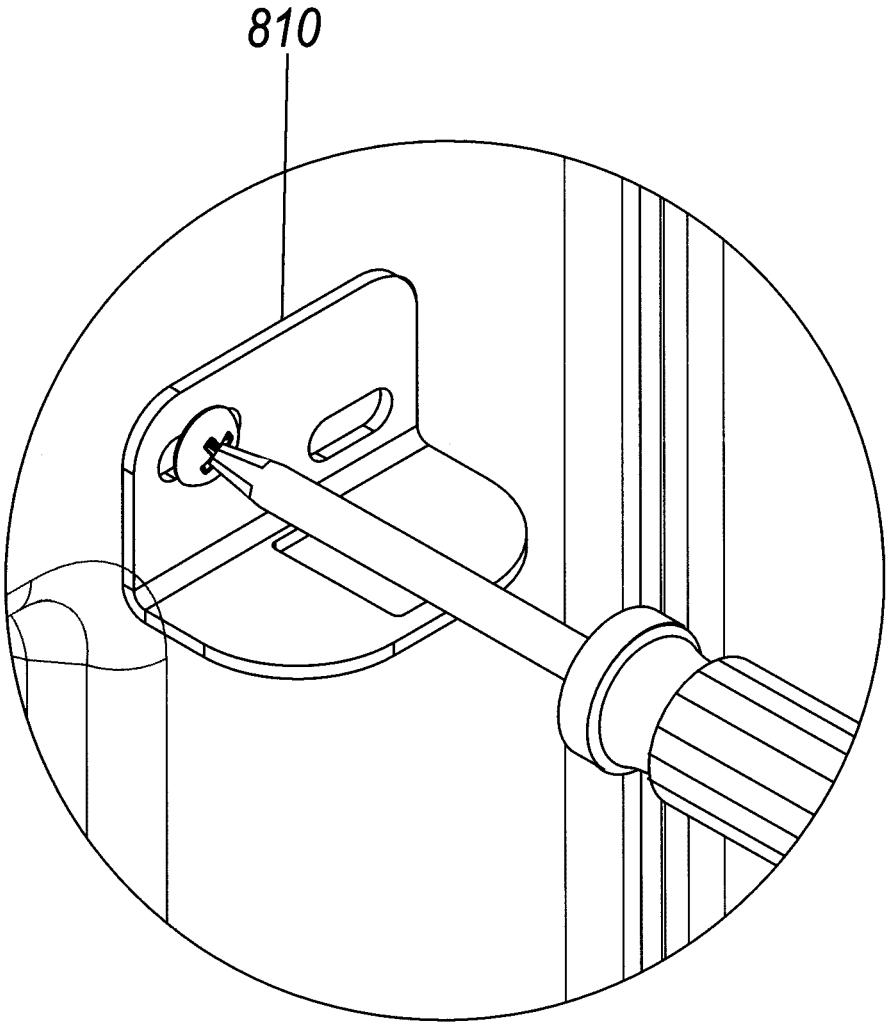
FIG. 31 is a view of one of the upper door latching members.
Figure 32:
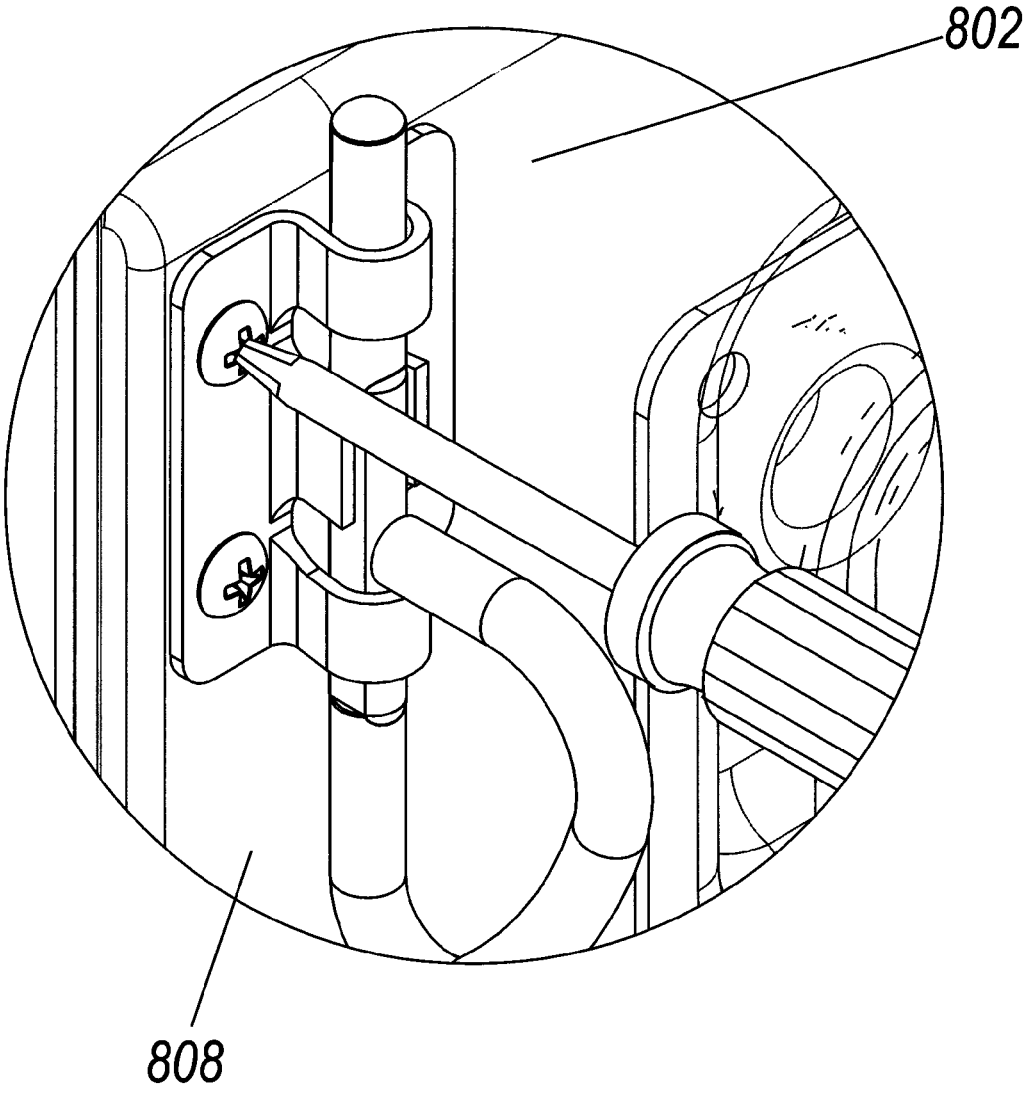
FIG. 32 is a view of another of the upper door latching members.
Figure 33:
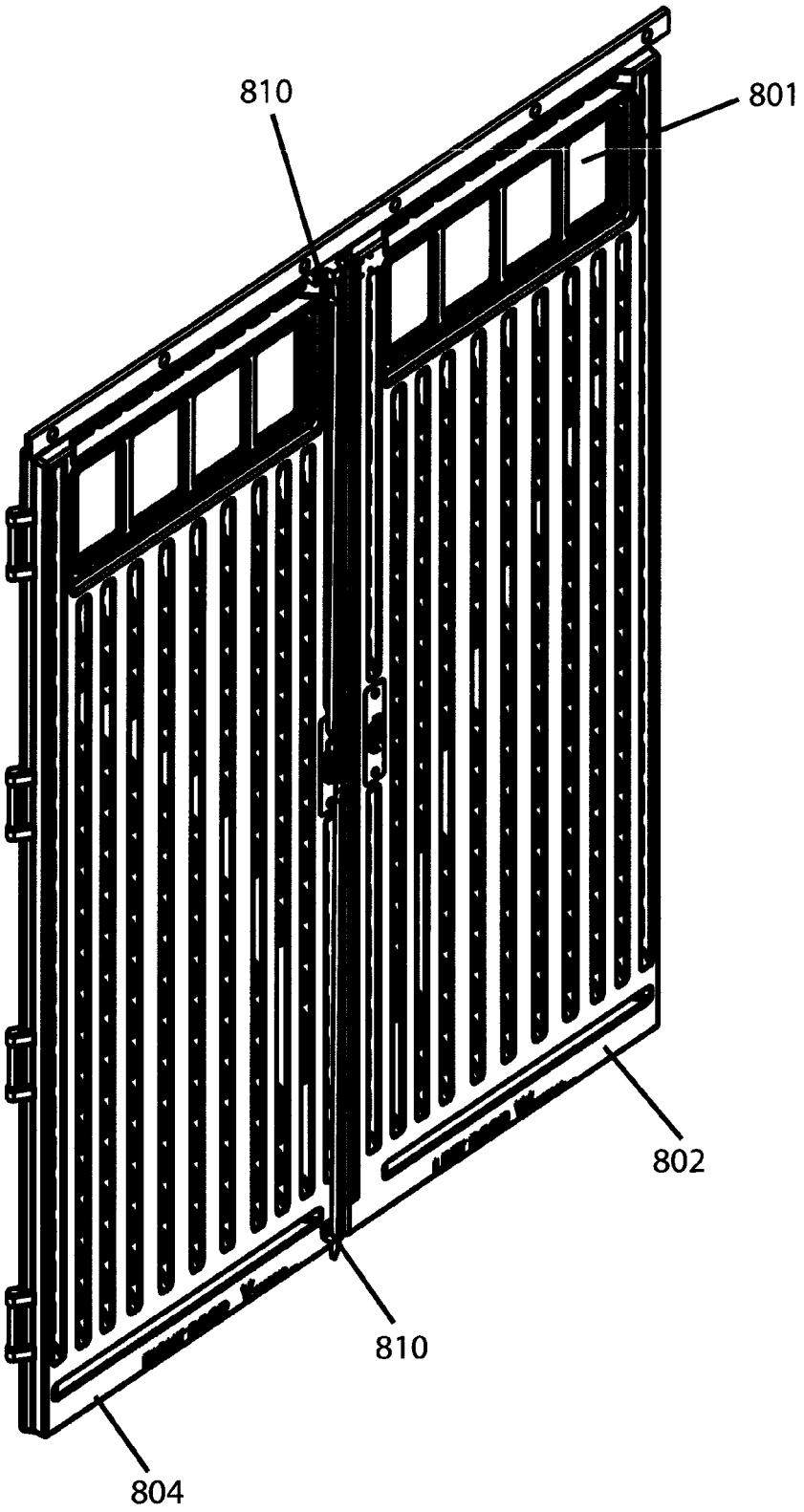
FIG. 33 is a view of the upper door latching member in relation to the door assembly.

The enclosure is provided with a door assembly 800 on the front wall. The door assembly preferably includes two doors; a left door 802 and a right door 804, FIG. 1. The doors are secured to the door frame by four hinges 806 per door in a preferred embodiment. FIGS. 25-27 illustrate the manner in which the right door 804 is secured to the enclosure. FIGS. 28 and 29 illustrate the manner in which the left door 802 is secured to the enclosure. FIGS. 30-33 illustrate a portion of the door latching mechanisms which are employed to maintain the doors in a closed and secure position. Latch member 808 is secured to one of the doors. In the preferred embodiment it is secured to the left door. The latch member 808 secures the door to the upper frame member, as illustrated in FIG. 33. The latch member 808 can only be operated from inside of the enclosure. A latch bar guide member 810 is secured to the upper portion of the right door 804 with fasteners, as illustrated in FIGS. 30 and 31. The latch bar guide member is employed with the latch bar, which will be described hereinafter.

Figure 34:
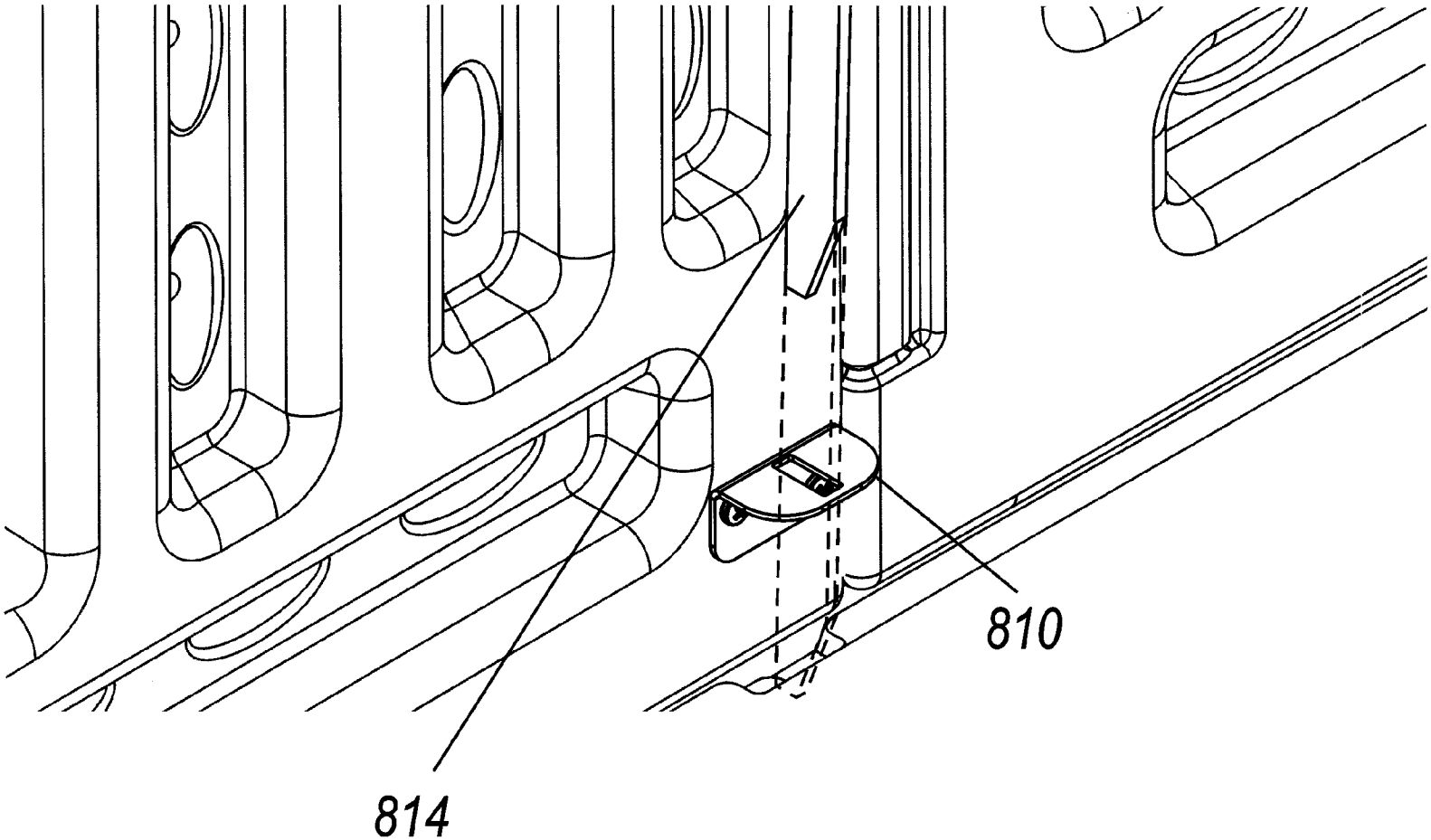
FIG. 34 is a view of a lower portion of the door latch bar.
Figure 35:
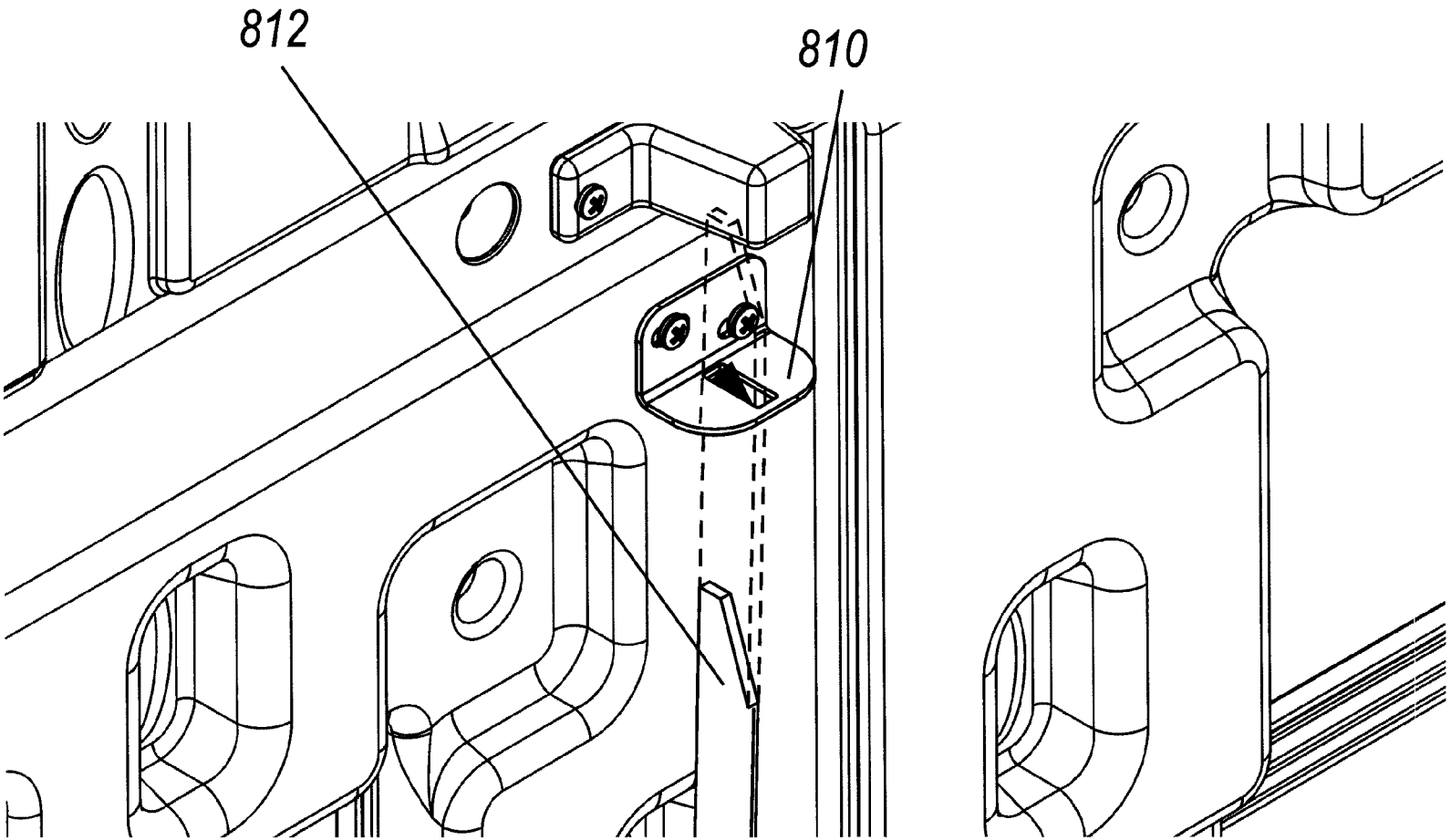
FIG. 35 is a view of an upper portion of the door latch bar.
Figure 36:
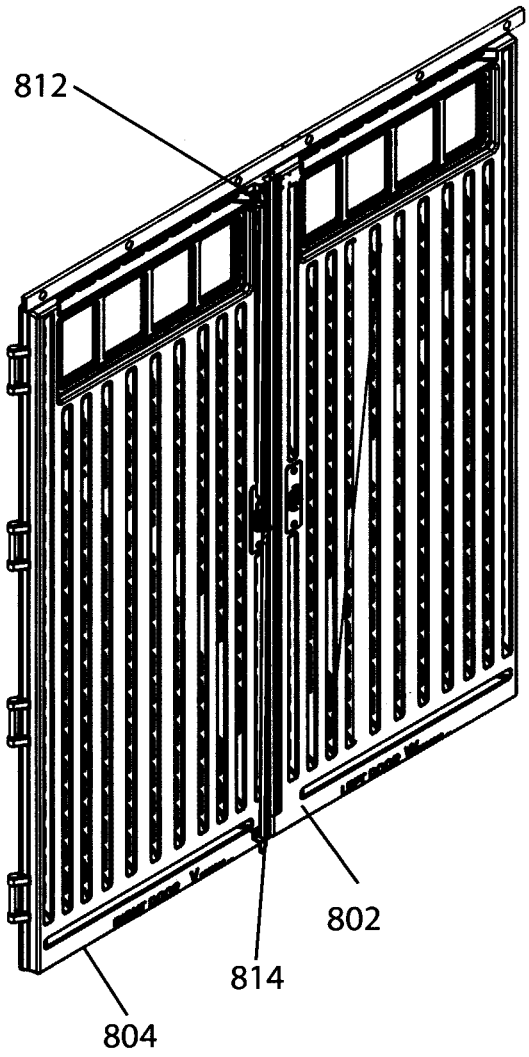
FIG. 36 is a view of the door latch bar in relation to the door assembly.
Figure 37:
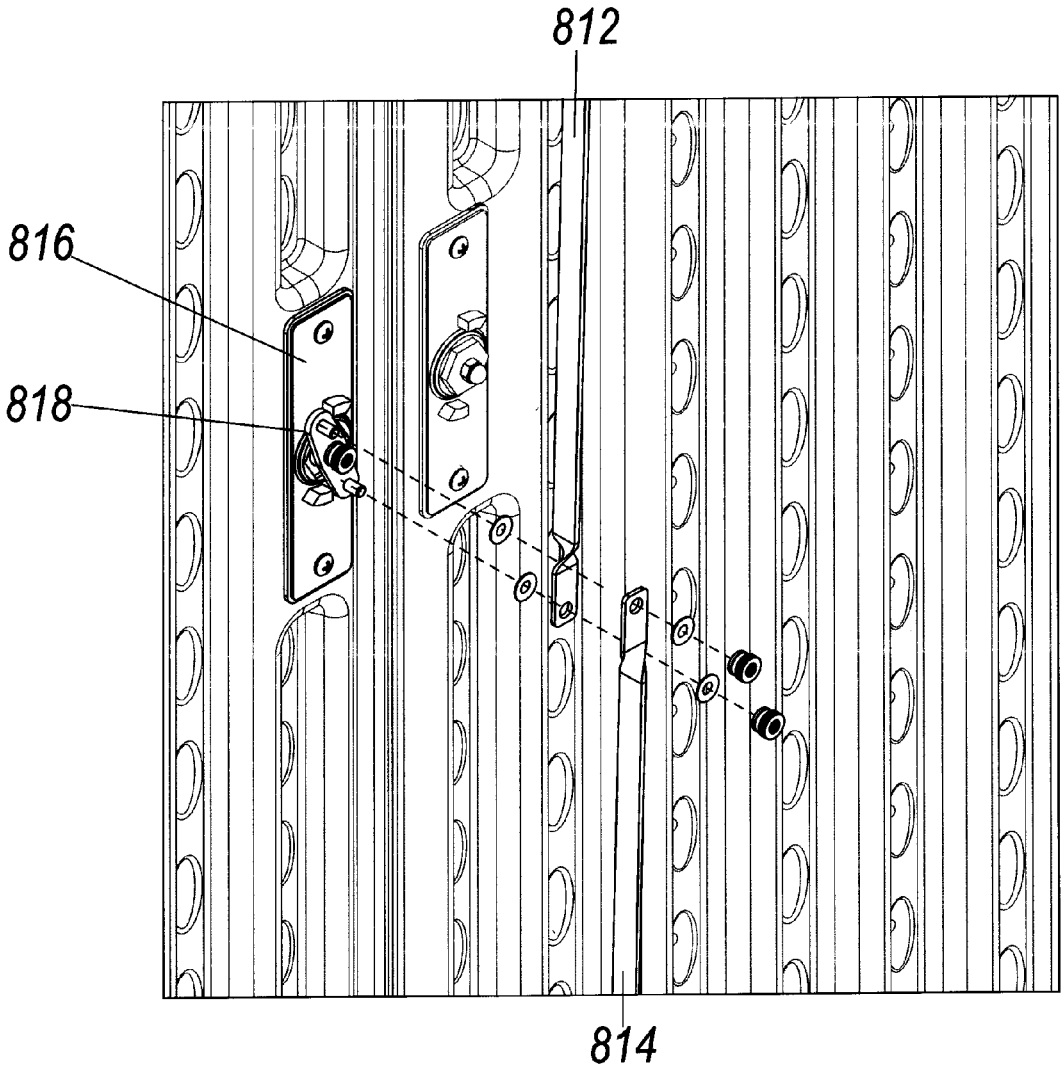
FIG. 37 is a view of the door latch bar operating mechanism.

Referring to FIGS. 33 and 36, illustrated is the inner surface of the doors having a latch bar includes two bar members 812 and 814. Member 812 is an upper latch bar member and element 814 is a lower latch bar member. FIGS. 34 and 35 illustrate the manner in which the latch bar members 812 and 814 pass through and are guided by the latch bar guide member 810. In FIGS. 34 and 35 the latch bar members 812 and 814 are illustrated in their open position by the solid lines and in the closed position by the dashed lines. In the closed position, the latch bar members 812 and 814 engage the latch bar guide members and the door frame, FIGS. 34-36. This prevents the door from opening. Each door includes window openings 801 along an upper edge of each door assembly.

Figure 38:
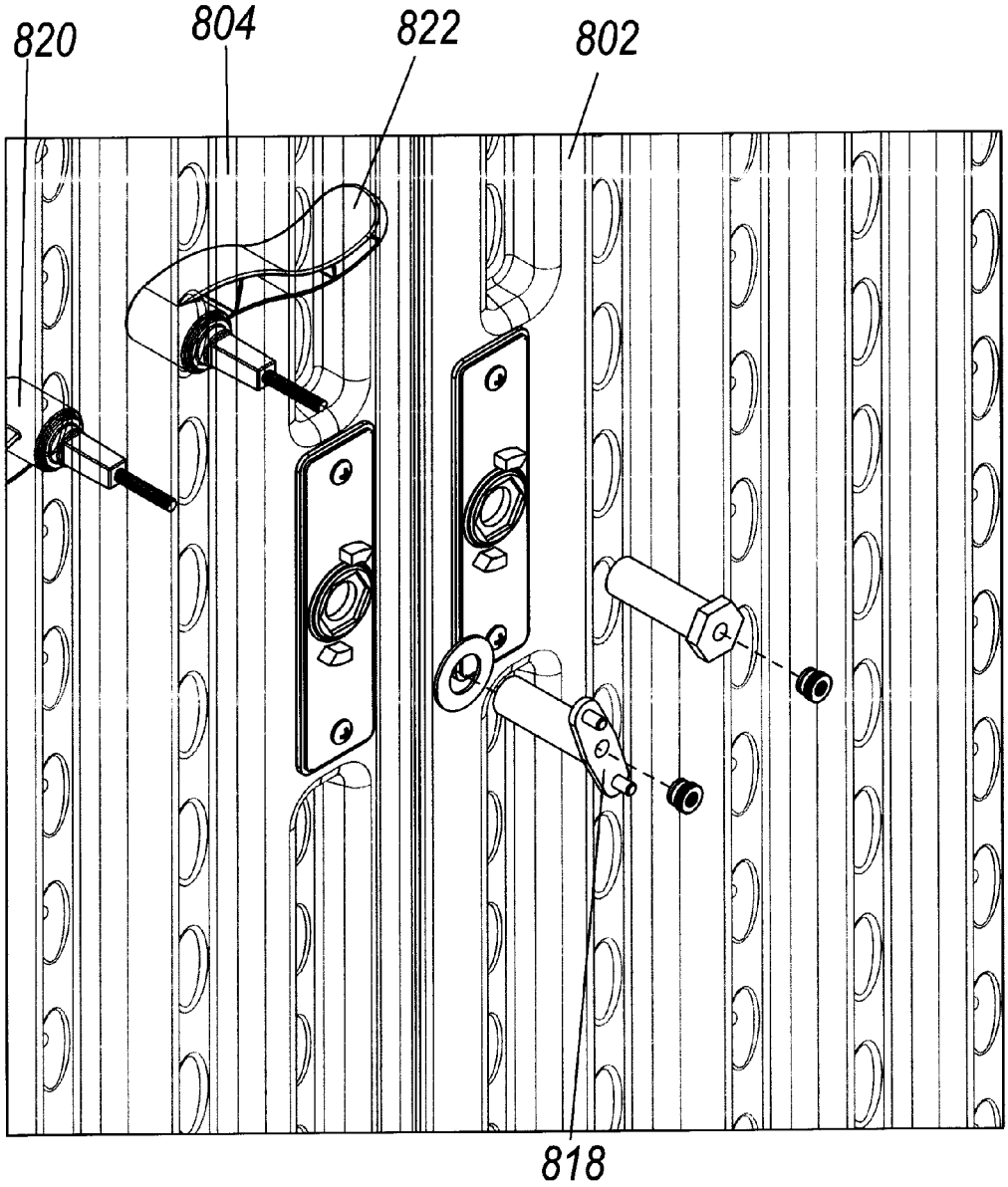
FIG. 38 is a view of a portion of the door latch operating mechanism.
Figure 39:
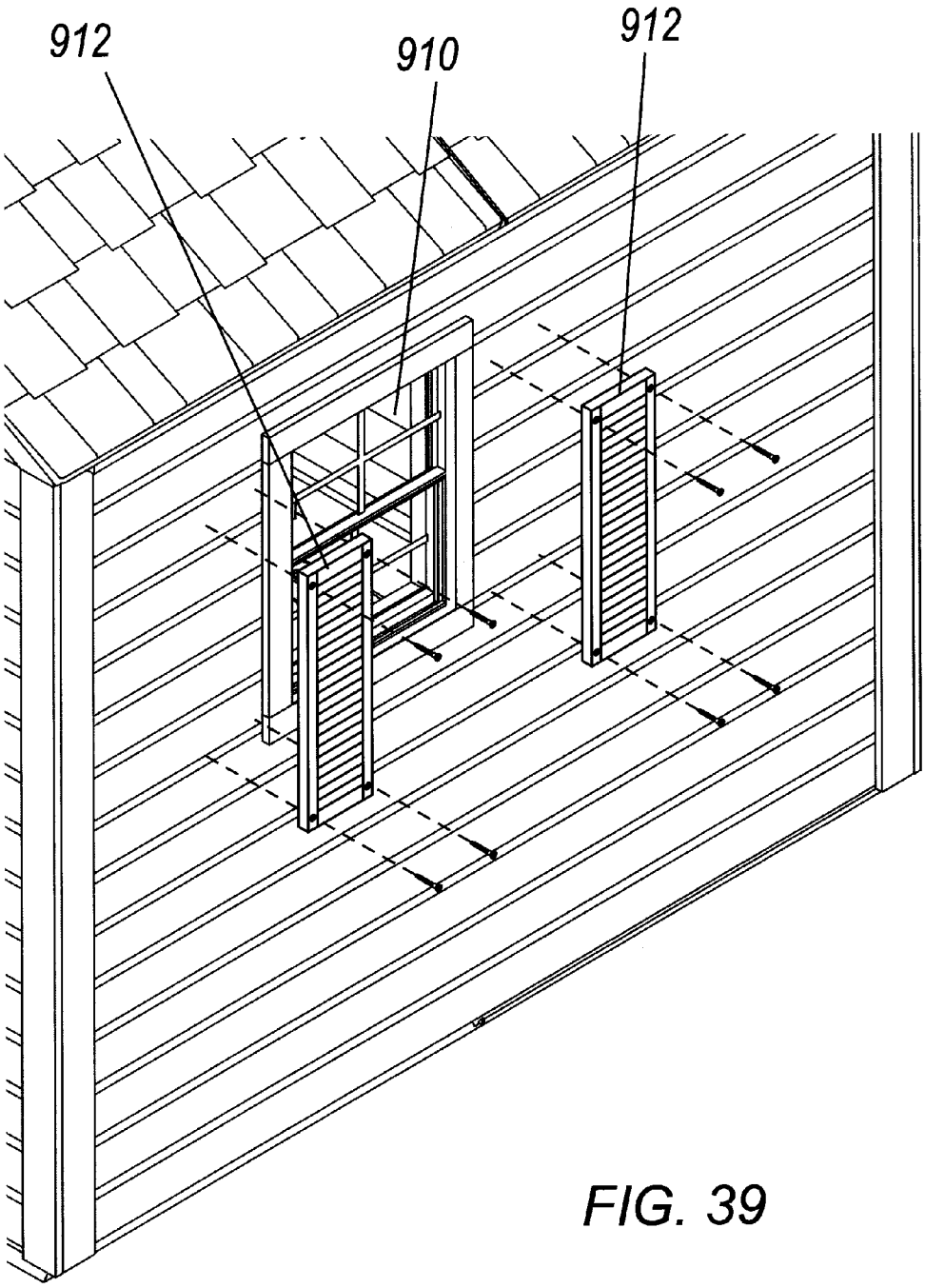
FIG. 39 is a view of the windows and shutters installed in the side walls.

FIGS. 38 and 39 illustrate the latch bar operating mechanism 816. Each of the ends of the latch bar members 812 and 814 is secured to the latch bar operating mechanism. The operating mechanism includes a rotating member 818 to which the latch bars are secured. The rotating member 818 is rotated or operated by a handle 820 located on the outside of the door. Rotation of the handle 820 rotates the member 818, which in turn raises or lowers the latch bars 812 and 814. The latch bars then engage or disengage the door frame enabling the door to be secured in the closed position or opened. Another handle 822 is positioned on door 804. This handle is used to pull open door 802. The rotating member 818 can optionally be placed on handle 822 and the latch bars mounted on door 802.

FIG. 43 illustrates a window 910 and shutters 912 which are secured in both the left and right wall assemblies. The window 910 is functional and can be opened and closed. The window permits the entry of natural light. The window also permits the entry of air to provide ventilation to the interior of the enclosure.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A utility shed construction kit comprising:

a floor assembly including a plurality of like-configured floor panel members, one of said floor panels including a plurality of tabs thereon along one edge, another of said floor panels including a plurality of recesses along one edge thereof, said tabs of one floor panel engaging said recesses of said other floor panel thereby interconnecting said floor panels together;

a pair of side wall assemblies for enclosing left and right sides of said utility shed, said side wall assemblies including a plurality of side wall wood frame members secured together and fastened to said floor assembly, at least one plastic wall panel secured to said side wall wood frame members to form said side wall assemblies, said side wall wood frame members including precut slots and predrilled holes whereby said side wall assemblies can be assembled without the use of measurement devices, said side wall wood frame members fitting within and cooperating with said precut slots to prevent twisting of said wood frame members with respect to each other;

a rear wall assembly for enclosing a rear portion of said utility shed, said rear wall assembly including a plurality of rear wall wood frame members secured together and fastened to said floor assembly, at least one plastic wall panel secured to said rear wall wood frame members to form said rear wall assembly, said rear wall wood frame members including precut slots and predrilled holes whereby said rear wall assembly can be assembled without the use of measurement devices, said rear wall wood frame members fitting within and cooperating with said precut slots to prevent twisting of said frame members with respect to each other;

a front wall assembly for enclosing a front portion of said utility shed, said front wall assembly including a plurality of front wall wood frame members secured together and fastened to said floor assembly, at least one plastic wall panel secured to said front wall wood frame members to form said front wall assembly, said front wall wood frame members including precut slots and predrilled holes whereby said front wall assembly can be assembled without the use of measurement devices, said front wall wood frame members fitting within and cooperating with said precut slots to prevent twisting of said front wall wood frame members with respect to each other;

a roof assembly for enclosing an upper portion of said utility shed, said roof assembly including a plurality of upper wood frame members secured together and fastened to said side wall assemblies to form roof trusses, said upper wood frame members including precut slots and predrilled holes whereby said roof trusses can be assembled without the use of measurement devices, said upper wood frame members fitting within and cooperating with said precut slots to prevent twisting of said upper wood frame members with respect to each other, a plurality of wood roof lathe members, said wood roof lathe members secured to all of said roof trusses to thereby form said roof assembly, a plurality of plastic roof panels secured to the upper portions of said roof trusses, said roof panels include a plurality of outwardly protruding members positioning members on an interior surface thereof, said positioning members constructed and arranged to cooperate with said roof trusses to permit the correct positioning of said roof panels on said roof trusses without the use of measuring devices; said roof panels completely covering said roof trusses and forming the top of said roof assembly; and a door assembly for permitting access to said utility shed, said door assembly is positioned within said front wall assembly.

2. The utility shed construction kit of claim 1 wherein said door assembly is further defined as two plastic doors, each of said doors is hingedly secured to said front wall assembly, each said door includes a latching device that secures the top and the bottom of one said door in a closed position.

3. The utility shed construction kit of claim 1 wherein said latching device is a upper and a lower bars movable in a vertical plane between a closed position wherein a distal end of each said bar engages a door frame, and an open position wherein said distal end of said bar does not engage said door frame enabling said door to be pivoted outwardly with respect to said front wall assembly to permit access to an interior of said utility shed.

4. The utility shed construction kit of claim 1 including a locking member secured to an upper portion of an inner surface of one of said doors, said locking member having a vertically movable element wherein said locking member engages an inner surface of said door frame to maintain said door in a closed position by movement when said element is positioned and an open position wherein said locking member does not engage said door frame enabling said door to be pivoted outwardly with respect to said front wall assembly to permit access to the interior of said utility shed.

5. The utility shed construction kit of claim 1 wherein said roof assembly includes a gable at each end of said roof assembly, said gable including siding on an exterior portion and a screened vent in an upper portion of said gable.

6. The utility shed construction kit of claim 1 including siding members on the exterior sides of said right, said left, said front and said rear wall assemblies.

7. The utility shed construction kit of claim 1 including a window in each said left and right side wall assemblies.

8. The utility shed construction kit of claim 1 including a ridge cap and an interlocking connection formed between adjacent roof panels, said interlocking connection providing a tortuous path between an upper surface of said roof panels and a lower surface of said roof panels thereby preventing the passage of water and other fluids between said upper surface and said lower surface of said roof panels and into said utility shed.

9. The utility shed construction kit of claim 1 wherein said floor panels are plastic.

* * * * *